US008632935B2

(12) United States Patent
Sugiyama et al.

(10) Patent No.: US 8,632,935 B2
(45) Date of Patent: Jan. 21, 2014

(54) METHOD FOR PRODUCING ELECTROPHOTOGRAPHIC PHOTOSENSITIVE MEMBER

(75) Inventors: Kazumichi Sugiyama, Numazu (JP); Daisuke Tanaka, Yokohama (JP); Tsutomu Nishida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/492,377

(22) Filed: Jun. 8, 2012

(65) Prior Publication Data

US 2013/0029266 A1 Jan. 31, 2013

(30) Foreign Application Priority Data

Jul. 29, 2011 (JP) ..... 2011-166765

(51) Int. Cl.
*G03G 5/147* (2006.01)

(52) U.S. Cl.
USPC ..... 430/127; 430/132

(58) Field of Classification Search
USPC ..... 430/127, 132
See application file for complete search history.

(56) References Cited

U.S. PATENT DOCUMENTS

| | | | |
|---|---|---|---|
| 4,444,861 | A | 4/1984 | Nogami et al. |
| 4,716,091 | A | 12/1987 | Yoshihara et al. |
| 5,437,952 | A | 8/1995 | Hirai et al. |
| 6,562,530 | B2 | 5/2003 | Morikawa et al. |
| 6,806,009 | B2 | 10/2004 | Tanaka et al. |
| 6,815,135 | B2 | 11/2004 | Morikawa et al. |
| 6,835,512 | B2 | 12/2004 | Morikawa et al. |
| 6,899,983 | B2 | 5/2005 | Tamoto et al. |
| 6,913,862 | B2 | 7/2005 | Nakata et al. |
| 6,998,210 | B2 | 2/2006 | Yoshimura et al. |
| 7,022,446 | B2 | 4/2006 | Yoshimura et al. |
| 7,078,140 | B2 | 7/2006 | Yoshimura et al. |
| 2011/0158683 | A1 | 6/2011 | Okuda et al. |

FOREIGN PATENT DOCUMENTS

| | | | |
|---|---|---|---|
| JP | 58-167606 | A | 10/1983 |
| JP | 58-209747 | A | 12/1983 |
| JP | 62-75462 | A | 4/1987 |
| JP | 5-249763 | A | 9/1993 |
| JP | 6-123987 | A | 5/1994 |
| JP | 7-261440 | A | 10/1995 |
| JP | 2001-343767 | A | 12/2001 |
| JP | 2002-128883 | A | 5/2002 |
| JP | 2003-295490 | A | 10/2003 |
| JP | 2007-47655 | A | 2/2007 |
| JP | 2007-72277 | A | 3/2007 |
| JP | 2007-79555 | A | 3/2007 |
| JP | 2007-199688 | A | 8/2007 |
| JP | 2009-37229 | A | 2/2009 |

OTHER PUBLICATIONS

Tanaka, et al., U.S. Appl. No. 13/490,419, filed Jun. 6, 2012.

*Primary Examiner* — Hoa V Le
(74) *Attorney, Agent, or Firm* — Fitzpatrick, Cella, Harper and Scinto

(57) ABSTRACT

The present invention provides a method for producing an electrophotographic photosensitive member including a surface layer, the method including the steps of: forming a coat for the surface layer on the support by applying a surface-layer coating solution and forming the surface layer by drying the coat, wherein the surface-layer coating solution includes a resin α, a resin β, a solvent γ and a compound δ.

13 Claims, 1 Drawing Sheet

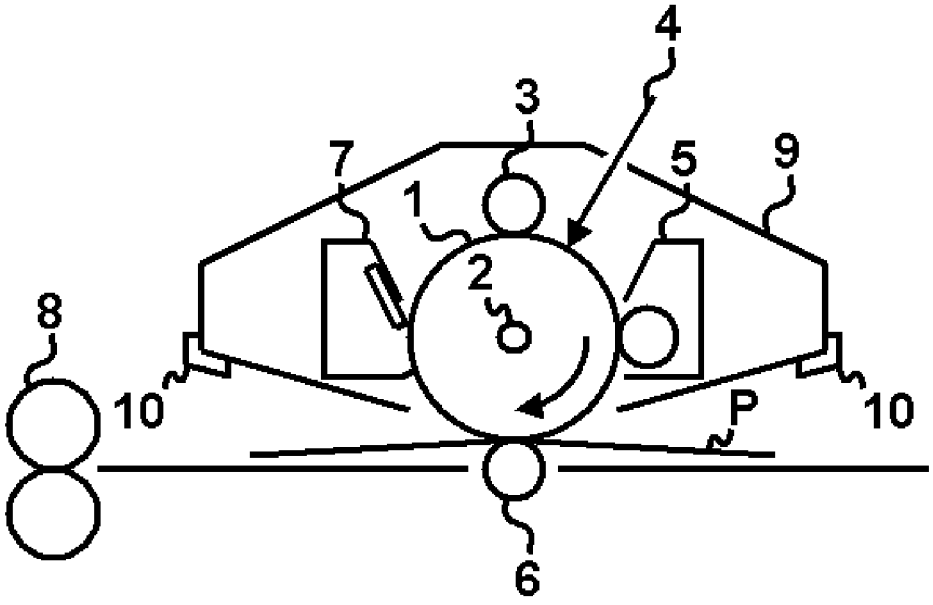
4
3
7
5
9
1
2
8
10
10
P
6

METHOD FOR PRODUCING ELECTROPHOTOGRAPHIC PHOTOSENSITIVE MEMBER

BACKGROUND OF THE INVENTION

1. Field of the Invention

The present invention relates to a method for producing an electrophotographic photosensitive member.

2. Description of the Related Art

As an electrophotographic photosensitive member to be mounted on an electrophotographic apparatus, an electrophotographic photosensitive member containing an organic photoconductive substance (charge generation substance) is commonly used. In an electrophotographic process, a cleaning step of removing a post-transfer residual toner by using a cleaning blade is demanded to reduce a contact stress (friction coefficient) between the cleaning blade and the electrophotographic photosensitive member, in order to suppress phenomena such as squeal of the cleaning blade and rubbing of the cleaning blade.

In order to reduce the contact stress of the electrophotographic photosensitive member, a technique has been proposed in which a siloxane-modified resin having a siloxane structure in the molecular chain is allowed to be contained in the surface layer of the electrophotographic photosensitive member, the surface layer being brought into contact with a contact member (such as cleaning blade). Japanese Patent Application Laid-Open No. 2009-037229 has disclosed a technique in which a resin having a siloxane structure incorporated into a polycarbonate resin is allowed to be contained in the surface layer, thereby reducing the contact stress (friction coefficient) between the electrophotographic photosensitive member and the cleaning blade.

The surface layer of the electrophotographic photosensitive member is formed by applying a surface-layer coating solution, that is obtained by dissolving or dispersing a binder resin or the like in a solvent, onto a support or the like to form a coat, and drying this coat. The solvent is selected with taking into consideration the solubility of the binder resin or the like, the absence of impact on electrophotographic characteristics, and the absence of whitening, drips and the like of the coat at the time of coating. Thus, various studies have been performed for the solvent to be used as the solvent of the coating solution from the viewpoint of simultaneously satisfying electrophotographic characteristics and coating properties. Japanese Patent Application Laid-Open No. 2001-343767 has proposed a method for producing an electrophotographic photosensitive member that is not whitened at the time of coating and that has electrophotographic characteristics equal to or more excellent than the case of using a halogenated solvent by using an aromatic hydrocarbon and ethylene glycol dimethyl ether as a solvent of a charge transport-layer coating solution. Japanese Patent Application Laid-Open No. H06-123987 has proposed that in order to suppress defects of the coat, the drying temperature at the time of producing an electrophotographic photosensitive member and the boiling point of a solvent to be used for a photosensitive-layer coating solution be adjusted.

SUMMARY OF THE INVENTION

As disclosed in Japanese Patent Application Laid-Open No. 2009-037229 and the like, the solvent to be used for the surface-layer coating solution contains a halogenated solvent such as monochlorobenzene from the viewpoint of solubility of the resin having a siloxane structure and other materials when the electrophotographic photosensitive member containing the resin having a siloxane structure in the surface layer is produced. However, the relationship between chemical substances and the environment has been recently focused, and the management of the chemical substances and the regulation of the amounts of the chemical substances discharged are tightened. As part of such circumstances, the halogenated solvent has been progressively substituted with a nonhalogen solvent. In addition, since the halogenated solvent must be separately recovered from the nonhalogenated solvent during the recovery of waste liquids to thereby easily deteriorate the productivity, there has been a demand for substituting the halogenated solvent with the nonhalogen solvent. The nonhalogenated solvent suitable for using for the surface-layer coating solution of the electrophotographic photosensitive member includes xylene and toluene.

However, if toluene or xylene is used for the solvent of the surface-layer coating solution containing the resin having a siloxane structure in order to reduce the contact stress of the surface layer, the effect of reducing the initial friction coefficient cannot be sufficiently achieved as compared with the case where monochlorobenzene is used. Therefore, there is a need for reducing the initial friction coefficient.

An object of the present invention is to provide a method for producing an electrophotographic photosensitive member, including the step of forming a surface layer by applying a surface-layer coating solution containing a resin having a siloxane structure and at least one of toluene and xylene, the method producing an electrophotographic photosensitive member that reduces the initial friction coefficient on the surface thereof.

The above objects are achieved according to the following present invention.

The present invention relates to a method for producing an electrophotographic photosensitive member including a surface layer, the method including the steps of: forming a coat for the surface layer by using a surface-layer coating solution and forming the surface layer by drying the coat, wherein the surface-layer coating solution includes:

(α) at least one resin selected from the group consisting of a polycarbonate resin not having a siloxane moiety at the end, and a polyester resin not having a siloxane moiety at the end, (β) at least one resin selected from the group consisting of a polycarbonate resin having a siloxane moiety at the end, a polyester resin having a siloxane moiety at the end, and an acrylic resin having a siloxane moiety at the end, (γ) at least one solvent selected from the group consisting of toluene and xylene, and (δ) a compound having the boiling point in one atmosphere higher than that of the (γ), the compound being represented by the following formula (1), and $$R^{10}O\text{-}E\text{-}(R^{11}O)_q\text{—}R^{12} \quad (1)$$

in the formula (1), $R^{10}$ represents a methyl group, an ethyl group, a propyl group, a cyclohexyl group, a phenyl group, or a benzyl group, $R^{11}$ represents a methylene group, an ethylene group, or a propylene group, $R^{12}$ represents a methyl group, an ethyl group, an acetyl group, a propionyl group, or a benzoyl group, E represents a single bond or a carbonyl group, q represents an integer number selected from 0 to 2.

According to the present invention, a method for producing an electrophotographic photosensitive member including the steps of forming a coat by applying a surface-layer coating solution containing a particular binder resin having a siloxane structure and at least one of toluene and xylene; and forming the surface layer by drying the coat, the method producing an electrophotographic photosensitive member that reduces the initial friction coefficient on the surface thereof, can be provided.

Further features of the present invention will become apparent from the following description of exemplary embodiments with reference to the attached drawings.

BRIEF DESCRIPTION OF THE DRAWING

FIGURE is a view illustrating one example of a schematic structure of an electrophotographic apparatus provided with a process cartridge including an electrophotographic photosensitive member according to the present invention.

DESCRIPTION OF THE EMBODIMENTS

Preferred embodiments of the present invention will now be described in detail in accordance with the accompanying drawings.

The production method of the present invention includes the steps of forming a coat for the surface layer by using a surface-layer coating solution and forming the surface layer by drying the coat, wherein the surface-layer coating solution includes as constituent elements, the above (α) (constituent element (α)), the above (β) (constituent element (pH and the above (γ) (constituent element (γ)), and also the above (δ) (constituent element (δ)). Hereinafter, the above (α) is also referred to as "resin α", the above (β) is also referred to as "resin β", the above (γ) is also referred to as "solvent γ", and the above (δ) is also referred to as "compound δ".

The present inventors presume that the reason why the surface-layer coating solution of the present invention contains the compound δ to thereby enable reducing the initial friction coefficient on the surface of the electrophotographic photosensitive member is as follows.

In the present invention, the surface of an electrophotographic photosensitive member having a low initial friction coefficient is obtained as follows: the resin having a siloxane structure of the resin β migrates to the surface of the electrophotographic photosensitive member (surface migration) and the siloxane structure is distributed on the surface of the electrophotographic photosensitive member. Such surface migration of the resin β is performed during the step of drying the coat formed by applying the surface-layer coating solution. In order that the resin β migrates to the surface of the photosensitive member, it is necessary that the resin α be in the state where the resin α is easily separated from the resin β during the drying step.

However, it is necessary that the resin α be compatible with the resin β to a certain extent from the viewpoints of stability of the coating solution (surface-layer coating solution) and uniformity of the coat. Therefore, it is necessary that the repeating structural unit of the resin having a siloxane structure of the resin β be selected so that the repeating structural unit is easily compatible with the resin α. If dimethylsilicone oil is used in place of the resin β of the present invention, the dimethylsilicone oil is hardly compatible with the resin α and easily migrates to the surface of the electrophotographic photosensitive member. However, since compatibility of the dimethylsilicone oil with the resin α is so low that the dimethylsilicone oil is scattered on the surface of the electrophotographic photosensitive member, an electrophotographic photosensitive member having an evenly low friction coefficient on the surface is not obtained. Also in the state of the coating solution, the dimethylsilicone oil is separated and becomes cloudy, and the stability of the solution is not sufficiently obtained.

On the other hand, if xylene or toluene is used as the solvent of the surface-layer coating solution, the resin α is easily compatible with the resin β and the resin α is hardly separated from the resin β in the drying step, and thus the resin β hardly migrates to the surface and a sufficient initial friction coefficient is not obtained. Therefore, in the present invention, the surface-layer coating solution includes the compound δ in order to create the state where the resin α is easily separated from the resin β during the drying step while maintaining the stability of the coating solution and the uniformity of the coat. The present inventors presume that the reason why the compound δ having a boiling point at one atmosphere higher than that of the solvent γ, the compound having the structure represented by the above formula (1), is contained so that the resin α is easily separated from the resin β is as follows.

A polar group (COO bond) in the repeating structural unit contained in the resin of the resin α and the resin β is highly compatible with a polar group (RO bond) of the compound δ. It is considered that the presence of the compound δ allows the repeating structural unit of the resin α and the repeating structural unit of the resin β to be tangled with difficulty to thereby lead to the state where the resin α is easily separated from the resin β. In addition, the compound δ has a boiling point higher than the boiling point of xylene of the solvent γ to thereby enable maintaining the state where the resin α is easily separated from the resin β until the end of the drying step. Because the compound δ has a boiling point higher than the boiling point of the solvent γ, the solvent γ is more previously volatilized than the compound δ in the drying step and thus the ratio of the compound δ is higher. Therefore, it is considered that while the content of the compound δ is lower than the content of the solvent γ in the surface-layer coating solution and thus the coating solution is stable, the content of the compound δ is higher in the coat in the course of drying to thereby lead to the state where the resin α is easily separated from the resin β.

Actually, with respect to the surface-layer coating solution including the resin α and the resin β, when the case where only the solvent γ is used as the solvent is compared with the case where the compound δ is further added besides the solvent γ, whitening possibly derived from the state where the resin α is separated from the resin β is observed in the surface-layer coating solution in the latter case.

<Regarding Compound δ>

The compound δ of the present invention is a compound having a boiling point in one atmosphere higher than that of the above (γ), the compound being represented by the following formula (1). The boiling point of xylene is 138 to 144° C.

$$R^{10}O\text{-}E\text{-}(R^{11}O)_q\text{—}R^{12} \quad (1)$$

In the formula (1), $R^{10}$ represents a methyl group, an ethyl group, a propyl group, a cyclohexyl group, a phenyl group, or a benzyl group. $R^{11}$ represents a methylene group, an ethylene group, or a propylene group. $R^{12}$ represents a methyl group, an ethyl group, an acetyl group, a propionyl group, or a benzoyl group. E represents a single bond or a carbonyl group. q is an integer of 0 to 2. If q is 0, E and $R^{12}$ are directly bound to each other.

The compound having a boiling point at one atmosphere higher than that of the above (γ) refers to as a compound having a boiling point at one atmosphere higher than that of toluene in the case where only toluene is used as the solvent γ, a compound having a boiling point at one atmosphere higher than that of xylene in the case where xylene and toluene are used as the solvent γ, or a compound having a boiling point at one atmosphere higher than that of xylene in the case where only xylene is used as the solvent γ.

The compound represented by the above formula (1) corresponding to any of the following cases is eliminated because the compound is a compound having a boiling point at one atmosphere lower than that of the above (γ). The specific cases include the case where q is 0, E represents a single bond, $R^{10}$ represents a methyl group, and $R^{12}$ represents a methyl group; the case where q is 0, E represents a single bond, $R^{10}$ represents a methyl group, and $R^{12}$ represents an ethyl group; the case where q is 0, E represents a single bond, $R^{10}$ represents a methyl group, and $R^{12}$ represents an acetyl group; the case where q is 0, E represents a single bond, $R^{10}$ represents an ethyl group, and $R^{12}$ represents a methyl group; the case where q is 0, E represents a single bond, $R^{10}$ represents an ethyl group, and $R^{12}$ represents an ethyl group; the case where q is 0, E represents a single bond, $R^{10}$ represents an ethyl group, and $R^{12}$ represents an acetyl group; the case where q is 0, $R^{10}$ represents a cyclohexyl group, and $R^{12}$ represents a methyl group; the case where q is 1, E represents a single bond, $R^{10}$ represents a methyl group, $R^{11}$ represents a methylene group, and $R^{12}$ represents a methyl group; the case where q is 1, E represents a single bond, $R^{10}$ represents a methyl group, $R^{11}$ represents an ethylene group, and $R^{12}$ represents a methyl group; and the case where q is 1, E represents a single bond, $R^{10}$ represents a methyl group, $R^{11}$ represents a propylene group, and $R^{12}$ represents a methyl group.

The specific compound of the compound δ includes methyl benzoate (boiling point: 200° C.), ethyl benzoate (boiling point: 213° C.), propyl benzoate (boiling point: 229° C.), ethylcyclohexyl ether (boiling point: 150° C.), cyclohexyl acetate (boiling point: 172° C.), cyclohexyl benzoate (boiling point: 285° C.), anisole (boiling point: 154° C.), phenetole (boiling point: 172° C.), phenyl acetate (boiling point: 195° C.), benzylmethyl ether (boiling point: 174° C.), benzylethyl ether (boiling point: 189° C.), benzyl acetate (boiling point: 212° C.), benzyl benzoate (boiling point: 324° C.), ethyl 3-ethoxypropionate (boiling point: 166° C.), diethylene glycol ethyl methyl ether (boiling point: 176° C.), diethylene glycol dimethyl ether (boiling point: 162° C.), diethylene glycol diethyl ether (boiling point: 189° C.), and dipropylene glycol dimethyl ether (boiling point: 175° C.). Herein, the boiling point in the parentheses denotes the boiling point at one atmosphere.

Among them, the compound δ can be methyl benzoate, ethyl benzoate, benzyl acetate, ethyl 3-ethoxypropionate, or diethylene glycol ethyl methyl ether.

The content of the compound δ in the surface-layer coating solution can be not less than 3% by mass and not more than 300% by mass relative to the total mass of the resin α and the resin β. The content of not less than 3% by mass and not more than 300% by mass is preferable from the viewpoints of the excellent action of separating the resin α from the resin β and the effect of reducing the initial friction coefficient on the surface of the photosensitive member. The content of not less than 5% by mass and not more than 80% by mass is also preferable from the viewpoint of solution stability of the surface-layer coating solution.

The content of the compound δ in the surface-layer coating solution can be not less than 0.5% by mass and not more than 150% by mass relative to the total mass of the solvent γ. The content of not less than 0.5% by mass and not more than 150% by mass is preferable from the viewpoints of the effect of reducing the initial friction coefficient on the surface of the photosensitive member and the effect of stability of the coating solution. In addition, from the viewpoint of solution stability of the surface-layer coating solution, the content is preferably not less than 0.5% by mass and not more than 40% by mass, and still preferably not less than 5% by mass and not more than 40% by mass.

<Regarding Resin α>

The resin α represents at least one resin of a polycarbonate resin not having a siloxane structure at the end and a polyester resin not having a siloxane structure at the end. The polycarbonate resin not having a siloxane structure at the end more specifically means a polycarbonate resin not having a siloxane structure at the both ends. The polyester resin not having a siloxane structure at the end more specifically means a polyester resin not having a siloxane structure at the both ends.

In the present invention, the polycarbonate resin not having a siloxane structure at the end can be a polycarbonate resin A having a repeating structural unit represented by the following formula (A). The polyester resin not having a siloxane structure at the end can be a polyester resin B having a repeating structure represented by the following formula (B).

(A)

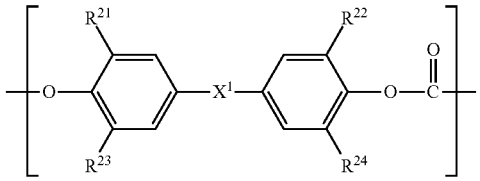

In the formula (A), $R^{21}$ to $R^{24}$ each independently represents a hydrogen atom or a methyl group. $X^1$ represents a single bond, a cyclohexylidene group, or a divalent group having a structure represented by the following formula (C).

(B)

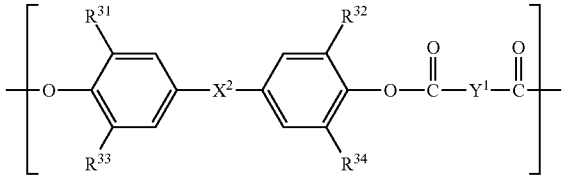

In the formula (B), $R^{31}$ to $R^{34}$ each independently represents a hydrogen atom or a methyl group. $X^2$ represents a single bond, a cyclohexylidene group, or a divalent group having a structure represented by the following formula (C). $Y^1$ represents a m-phenylene group, a p-phenylene group, or a divalent group having two p-phenylene groups bounded with an oxygen atom.

(C)

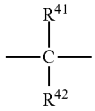

In the formula (C), $R^{41}$ and $R^{42}$ each independently represents a hydrogen atom, a methyl group or a phenyl group.

Specific examples of the repeating structural unit of the polycarbonate resin A represented by the formula (A) are illustrated below.

(A-1)

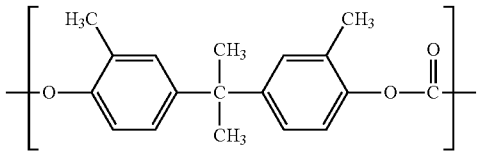

-continued (A-2)

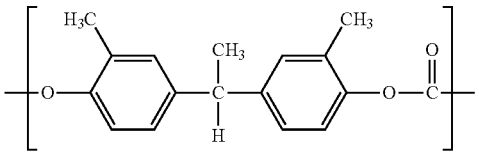

(A-3)

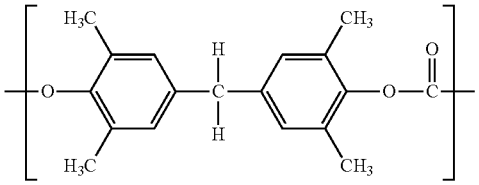

(A-4)

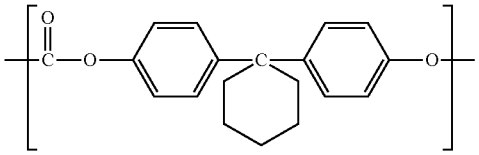

(A-5)

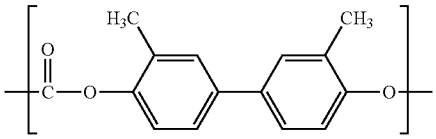

-continued (A-6)

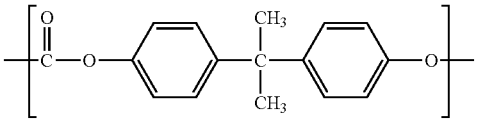

(A-7)

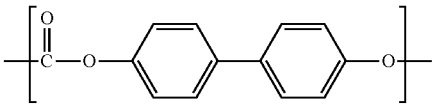

(A-8)

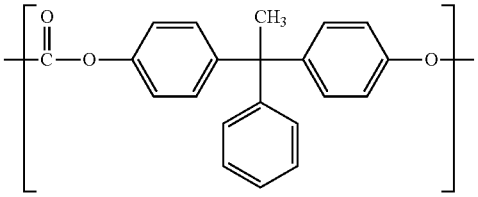

Among them, the repeating structural units represented by the formulas (A-1), (A-2) and (A-4) are preferable.

The polycarbonate resin A can be synthesized by, for example, a conventional phosgene method, and can also be synthesized by an interesterification method.

Specific examples of the repeating structural unit of the polyester resin B represented by the formula (B) are illustrated below.

(B-1)

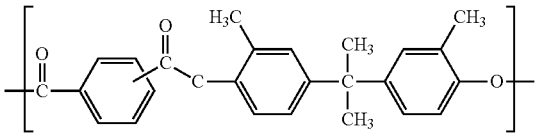

(B-2)

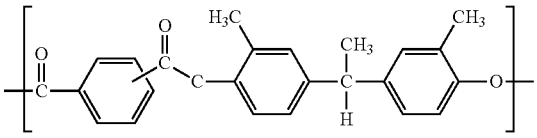

(B-3)

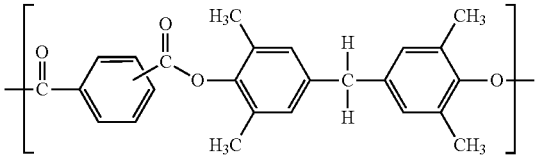

(B-4)

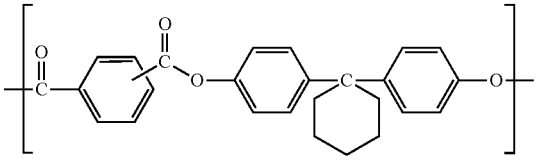

(B-5)

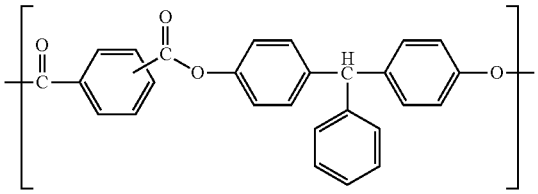

(B-6)

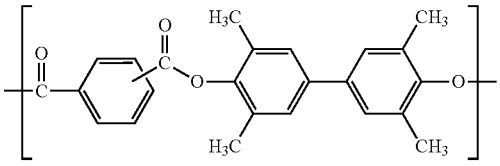

(B-7)

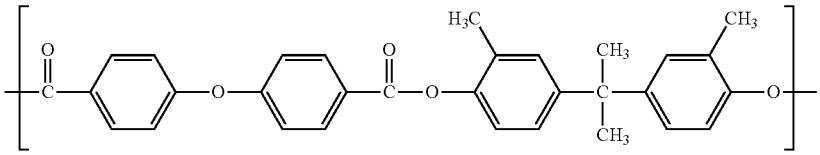

-continued (B-8)

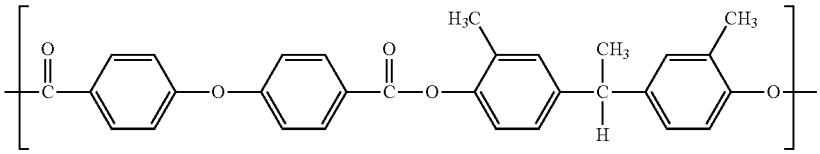

(B-9)

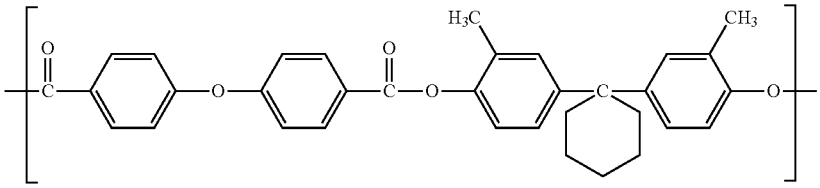

Among them, the repeating structure represented by the formulas (B-1), (B-2), (B-3), (B-6), (B-7) and (B-8) are preferable.

The polycarbonate resin A and the polyester resin B can be synthesized by any known method, and can be synthesized by the method described in, for example, Japanese Patent Application Laid-Open No. 2007-047655 or Japanese Patent Application Laid-Open No. 2007-072277.

One or two or more of the polycarbonate resin A and the polyester resin B can be used alone, can be mixed, or can be used as a copolymer. The copolymerization forms of the polycarbonate resin A and the polyester resin B may be any of block copolymerization, random copolymerization, alternating copolymerization and the like.

The weight average molecular weight of each of the polycarbonate resin A and the polyester resin B is preferably not less than 20,000 and not more than 300,000, and more preferably not less than 50,000 and not more than 200,000.

In the present invention, the weight average molecular weight of the resin means a weight average molecular weight in terms of polystyrene measured by the method described in Japanese Patent Application Laid-Open No. 2007-79555 according to the common method.

The polycarbonate resin A and the polyester resin B as the resin α may be a copolymer having a repeating structural unit containing a siloxane structure besides the structural unit represented by the formula (A) or the formula (B). Specific examples include repeating structural units represented by the following formulas (H-1) and (H-2). The polycarbonate resin A and the polyester resin B may further have a repeating structural unit represented by the following formula (H-3).

(H-1)

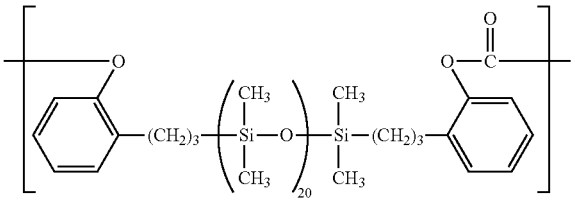

(H-2)

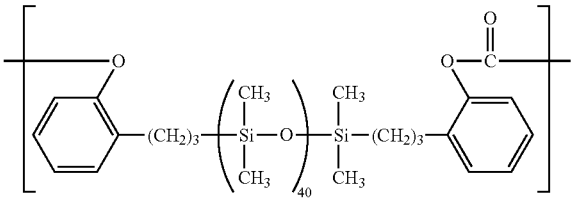

-continued (H-3)

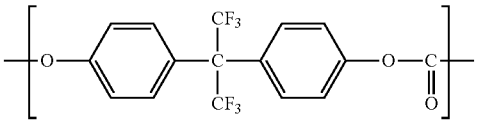

Specific resins to be used as the resin α are shown below.

TABLE 1

| Component [α] (Polycarbonate Resin A•Polyester Resin B) | Repeating structural unit | Ratio of repeating structural units (mass ratio) | Weight average molecular weight (Mw) |
|---|---|---|---|
| Resin A(1) | (A-4) | — | 55,000 |
| Resin A(2) | (A-4) | — | 14,000 |
| Resin A(3) | (A-4) | — | 110,000 |
| Resin A(4) | (A-6) | — | 55,000 |
| Resin A(5) | (A-1) | — | 54,000 |
| Resin A(6) | (A-6)/(A-1) | 6.5/3.5 | 55,000 |
| Resin A(7) | (A-4)/(H-1) | 9/1 | 55,000 |
| Resin A(8) | (A-4)/(H-1) | 9/1 | 110,000 |
| Resin A(9) | (A-4)/(H-1)/(H-3) | 6/1.5/2.5 | 60,000 |
| Resin B(1) | (B-1) | — | 120,000 |
| Resin B(2) | (B-1)/(B-6) | 7/3 | 120,000 |
| Resin B(3) | (B-8) | — | 100,000 |

In Table 1, with respect to the repeating structural units represented by the formulas (B-1) and (B-6) in the resin B(1) and the resin B(2), the molar ratio of a terephthalic acid structure to an isophthalic acid structure (terephthalic acid backbone:isophthalic acid backbone) is 5/5.

<Regarding Resin β>

The resin β has at least one resin selected from the group consisting of a polycarbonate resin having a siloxane structure at the end, a polyester resin having a siloxane structure at the end, and an acrylic resin having a siloxane structure at the end. The polycarbonate resin having a siloxane structure at the end includes a polycarbonate resin having a siloxane structure at the end of only one side and a polycarbonate resin having siloxane structure at the both ends. The polyester resin having a siloxane structure at the end includes a polyester resin having a siloxane structure at the end of only one side and a polyester resin having a siloxane structure at the both ends. The acrylic resin having a siloxane structure at the end includes an acrylic resin having a siloxane structure at the end of only one side and an acrylic resin having a siloxane structure at the both ends.

In the present invention, the resin having a siloxane structure at the end is used to thereby have high lubricating properties on the surface of the photosensitive member and reducing the initial friction coefficient. The reason for this is considered to be due to the following that the incorporation of a dimethylpolysiloxane moiety at the end allows such a siloxane portion to have a high degree of freedom and high surface migration properties.

A resin having a siloxane structure at the end in the resin β includes a polycarbonate resin, a polyester resin, and an acrylic resin from the viewpoints of the compatibility with the resin α, the stability of the coating solution, and coating property.

In the present invention, the polycarbonate resin having a siloxane structure at the end can be a polycarbonate resin D having a repeating structural unit represented by the following formula (A') and an end structure represented by the following formula (D). The polyester resin having a siloxane structure at the end can also be a polyester resin E having a repeating structural unit represented by the following formula (B') and an end structure represented by the following formula (D).

(A')

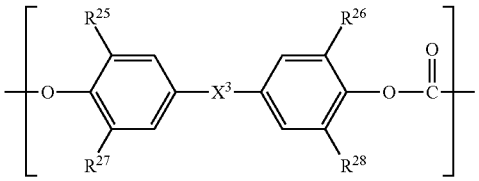

In the formula (A'), $R^{25}$ to $R^{28}$ each independently represents a hydrogen atom or a methyl group. $X^3$ represents a single bond, a cyclohexylidene group, or a divalent group having a structure represented by the following formula (C').

(B')

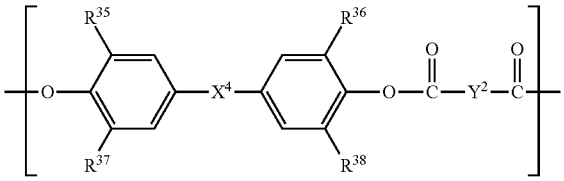

In the formula (B'), $R^{35}$ to $R^{38}$ each independently represents a hydrogen atom or a methyl group. $X^4$ represents a single bond, a cyclohexylidene group, or a divalent group having a structure represented by the following formula (C'). $Y^2$ represents a m-phenylene group, a p-phenylene group, or a divalent group having two p-phenylene groups bounded with an oxygen atom.

(C')

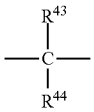

In the formula (C'), $R^{43}$ and $R^{44}$ each independently represents a hydrogen atom, a methyl group or a phenyl group.

(D)

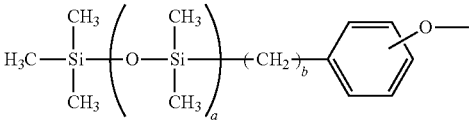

In the formula (D), a and b represent the number of the repetition of the structure within the bracket. The average value of a is not less than 20 and not more than 100, and the average value of b is not less than 1 and not more than 10, in the polycarbonate resin D or the polyester resin E. More preferably, the average value of a is not less than 30 and not more than 60, and the average value of b is not less than 3 and not more than 10.

In the present invention, the polycarbonate resin D and the polyester resin E have the end structure represented by the formula (D) at one end or both ends of the resin. In the case where the resin D and the resin E have the end structure represented by the formula (D) at one end, a molecular weight regulator (end terminator) is used. The molecular weight regulator includes phenol, p-cumylphenol, p-tert-butylphenol and benzoic acid. In the present invention, the molecular weight regulator can be phenol or p-tert-butylphenol.

In the case where the resin D and the resin E have the end structure represented by the formula (D) at one end, the structure at the other one end (other end structure) is a structure represented below.

(G-1)

(G-2)

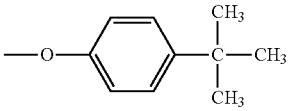

Specific examples of the end structure represented by the formula (D) are illustrated below.

(D-1)

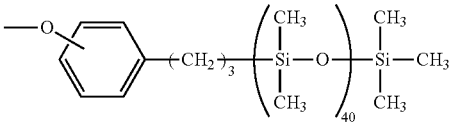

(D-2)

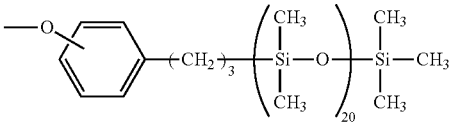

(D-3)

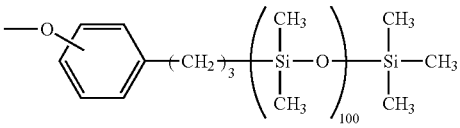

(D-4)

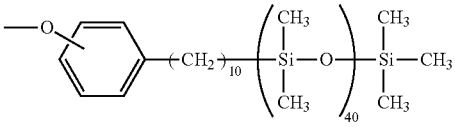

-continued (D-5)

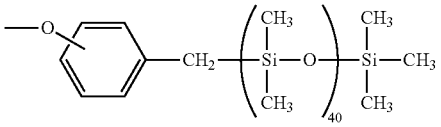

One or two or more of the polycarbonate resin D and the polyester resin E can be used alone, can be mixed, or can be used as a copolymer. The copolymerization forms of the polycarbonate resin D and the polyester resin E may be any of block copolymerization, random copolymerization, alternating copolymerization and the like. The polycarbonate resin D and the polyester resin E may also have the repeating structural unit having a siloxane structure in the main chain, and may also be, for example, a copolymer having a repeating structural unit represented by the following formula (H).

(H)

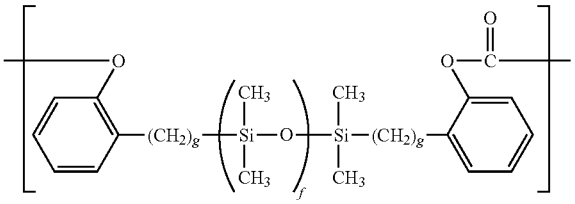

In the formula (H), f and g represent the number of the repetition of the structure within the bracket. The average value of f can be not less than 20 and not more than 100, and the average value of g can be not less than 1 and not more than 10, in the polycarbonate resin D or the polyester resin E. Specific repeating structural units as the repeating structural unit represented by the formula (H) include the formulas (H-1) and (H-2).

In the polycarbonate resin D, specific examples of the repeating structural unit represented by the formula (A') include the repeating structural units represented by the formulas (A-1) to (A-8). The repeating structural unit represented by the formulas (A-1), (A-2) and (A-4) are preferable. In the polyester resin E, specific examples of the repeating structural unit represented by the formula (B') include the repeating structural units represented by the formulas (B-1) to (B-9). The repeating structural unit represented by the formulas (B-1), (B-3), (B-6), (B-7) and (B-8) are preferable. Among them, the repeating structural units represented by the formulas (A-4), (B-1) and (B-3) are particularly preferable.

In the present invention, the siloxane moiety in the polycarbonate resin D and the polyester resin E refers to a moiety in a dotted flame of an end structure represented by the following formula (D-S). In the case where the polycarbonate resin D and the polyester resin E have the repeating structural unit represented by the formula (H), a structure in a dotted flame of a repeating structure represented by the following formula (H-S) is also included in the siloxane moiety.

(D-S)

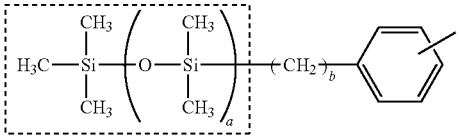

-continued (H-S)

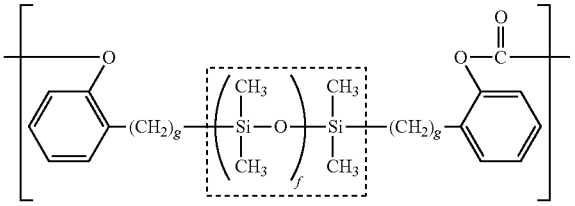

In the present invention, the polycarbonate resin D and the polyester resin E can be synthesized by any known method, and can be synthesized by the method described in, for example, Japanese Patent Application Laid-Open No. 2007-199688. Also in the present invention, the same method was used and raw materials according to the polycarbonate resin D and the polyester resin E were used, thereby synthesizing the polycarbonate resin D and the polyester resin E shown in Synthesis Examples in Table 2. Herein, the polycarbonate resin D and the polyester resin E were purified as follows: the resin D and the resin E were fractioned and separated from each other by using size exclusion chromatography, and then each fractioned component was measured by means of $^1$H-NMR to determine a composition of each resin by the relative ratio of the siloxane moiety in each resin. The weight average molecular weights and the contents of the siloxane moieties in the synthesized polycarbonate resin D and the polyester resin E are shown in Table 2.

Specific examples of the polycarbonate resin D and the polyester resin E are shown below.

TABLE 2

| Component [β] (Polycarbonate resin D•Polyester resin E) | Repeating structural unit in main chain | Siloxane structure at end | Other end structure | Content of siloxane moiety (% by mass) | Weight average molecular weight (Mw) |
|---|---|---|---|---|---|
| Resin D(1) | (A-4) | (D-1) | — | 23% | 50,000 |
| Resin D(2) | (A-2) | (D-5) | — | 25% | 48,000 |
| Resin D(3) | (A-4)/(H-2) | (D-1) | — | 32% | 54,000 |
| Resin D(4) | (A-4) | (D-1) | (G-1) | 13% | 48,000 |
| Resin D(5) | (A-4) | (D-1) | (G-2) | 12% | 49,000 |
| Resin E(1) | (B-1) | (D-1) | — | 22% | 42,000 |

In Table 2, the mass ratio of each repeating structural unit in the main chain in the resin D(3) satisfies (A-4):(H-2)=9:1.

In the present invention, the acrylic resin having a siloxane structure at the end can be an acrylic resin F having a repeating structural unit represented by the following formula (F-1) and a repeating structural unit represented by the following formula (F-2), or a repeating structural unit represented by the following formula (F-1) and a repeating structural unit represented by the following formula (F-3).

(F-1)

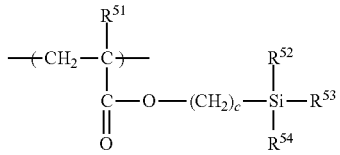

$R^{51}$ represents hydrogen or a methyl group. c represents the number of the repetition of the structure within the bracket, and the average value of c is not less than 0 and not more than 5, in the acrylic resin F. $R^{52}$ to $R^{54}$ each independently represents a structure represented by the following formula (F-1-2), a methyl group, a methoxy group or a phenyl group. At least one of $R^{52}$ to $R^{54}$ has a structure represented by the following structure (F-1-2).

(F-1-2)

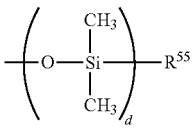

In the formula (F-1-2), d represents the number of the repetition of the structure within the bracket, and the average value of d is not less than 10 and not more than 50, in the acrylic resin F. $R^{55}$ represents a hydroxyl group or a methyl group.

(F-2)

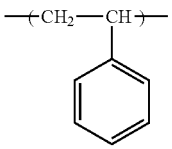

-continued (F-3)

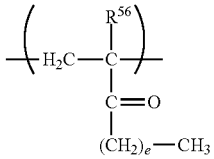

In the formula (F-3), $R^{56}$ represents hydrogen, a methyl group or a phenyl group. e represents 0 or 1.

In the present invention, the siloxane moiety in the acrylic resin F refers to a moiety in a dotted flame of a structure represented by the following formula (F-S) or formula (F-T).

(F-S)

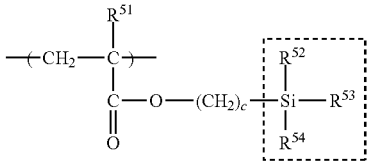

(F-T)

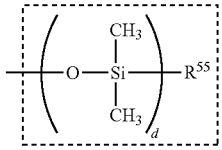

Specific examples of the repeating structural unit in the acrylic resin F are shown in Table 3 below.

TABLE 3

| Compound Example | (F-1) | (F-2) or (F-3) | Weight ratio of repeating structure units | Weight average molecular weight Mw |
|---|---|---|---|---|
| F-A | 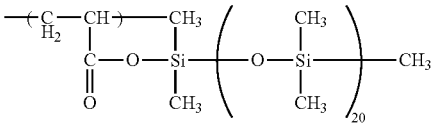 | 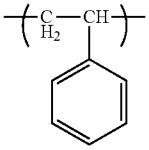 | 2/8 | 105,000 |
| F-B | 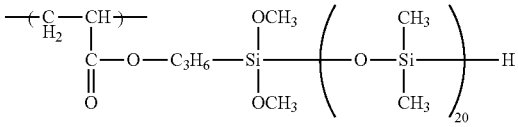 | 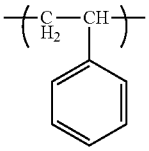 | 2/8 | 100,000 |
| F-C | 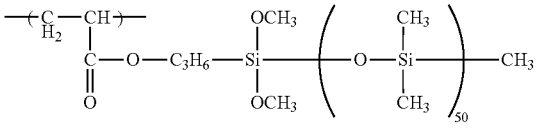 | 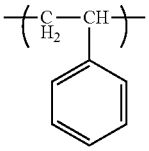 | 1/9 | 100,000 |
| F-D | 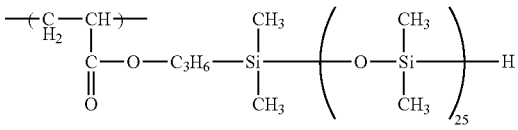 | 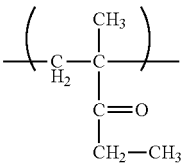 | 1/9 | 105,000 |

TABLE 3-continued

| Compound Example | (F-1) | (F-2) or (F-3) | Weight ratio of repeating structure units | Weight average molecular weight Mw |
|---|---|---|---|---|
| F-E | 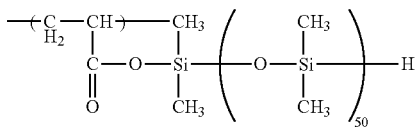 | 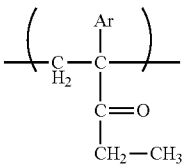 | 2/8 | 110,000 |
| F-F | 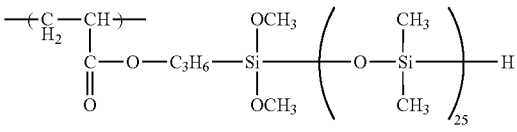 | 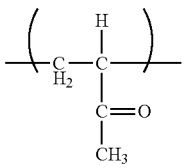 | 1.5/8.5 | 100,000 |
| F-G | 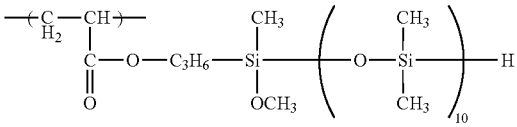 | 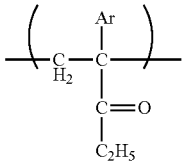 | 1/9 | 110,000 |

Among the acrylic resins F represented by the above Table 3, resins represented by Compound Examples (F-B) and (F-D) are preferable.

Such acrylic resins can be synthesized by any known method. Such acrylic resins can be synthesized by the method described in, for example, Japanese Patent Application Laid-Open No. S58-167606 or Japanese Patent Application Laid-Open No. S62-75462.

The content of the resin β in the surface-layer coating solution can be not less than 0.1% by mass and not more than 50% by mass relative to the content of the resin α. The content of not less than 0.1% by mass and not more than 50% by mass allows the effect of reducing the initial friction coefficient to be sufficiently exerted.

<Regarding Solvent γ>

In the surface-layer coating solution of the present invention, the solvent γ is at least one selected from the group consisting of toluene and xylene. Specifically, the solvent γ includes toluene (boiling point: 111° C.), o-xylene (boiling point: 144° C.), m-xylene (boiling point: 139° C.), p-xylene (boiling point: 138° C.), and mixed xylene (boiling point: 138 to 144° C.). The solvent γ can be o-xylene. These solvents may be used alone or two or more thereof may be mixed for use. Herein, the boiling point in the parentheses denotes the boiling point at one atmosphere.

The surface-layer coating solution of the electrophotographic photosensitive member of the present invention includes at least one of toluene and xylene, and may further include other solvent in order to form a surface layer having a uniform film thickness. Such other solvent can include a chain ether or a cyclic ether having a low boiling point. The chain ether having a low boiling point includes dimethoxymethane, and the cyclic ether having a low boiling point include tetrahydrofuran (THF). At least one of dimethoxymethane and tetrahydrofuran (hereinafter, also referred to as the above (ϵ)) can be used. In this case, the content of the solvent γ can be not less than 15% by mass and not more than 99% by mass, the content of the compound δ can be not less than 0.5% by mass and not more than 35% by mass, and the content of the above (ϵ) can be not less than 0.1% by mass and not more than 65% by mass, relative to the total mass of the solution of the solvent γ, the compound δ and the above (ϵ).

Then, the configuration of the electrophotographic photosensitive member according to the present invention will be described.

The electrophotographic photosensitive member according to the present invention includes a support and a photosensitive layer formed on the support. The photosensitive layer includes a one-layer type photosensitive layer containing a charge transport substance and a charge generation substance in one layer; and a laminate type (functional separation type) photosensitive layer in which a charge generation layer containing a charge generation substance and a charge transport layer containing a charge transport substance are separated from each other. The laminate type photosensitive layer can be used in the present invention. The charge generation layer may have a laminated structure, and the charge transport layer may have a laminated configuration. For the purpose of enhancing durability of the electrophotographic photosensitive member, a protective layer may be formed on the photosensitive layer.

With respect to the surface layer of the electrophotographic photosensitive member according to the present invention, when the charge transport layer is the topmost surface, the charge transport layer is the surface layer, and on the other hand, when the protective layer is provided on the charge transport layer, the protective layer is the surface layer.

<Support>

The support means a support having conductivity (conductive support). Examples of the support include supports made of metals such as aluminum, stainless, copper, nickel and zinc or alloys of such metals. In the case where the support is made of aluminum or an aluminum alloy, an ED pipe, an EI pipe, or a pipe obtained by subjecting these pipes to cutting, electrolytic composite polishing (electrolysis with an electrode having electrolytic action and an electrolytic solution and polishing with a grinding stone having polishing action), and a wet-process or dry-process honing treatment can also be used. The support also includes a support made of metal and a support where a conductive material such as aluminum, an aluminum alloy or an indium oxide-tin oxide alloy is formed on a resin support in the form of a thin film.

A support where conductive particles such as carbon black, tin oxide particles, titanium oxide particles or silver particles are impregnated with a resin or the like, and a plastic having a conductive binder resin can also be used.

For the purpose of preventing interference fringes caused by scattering of laser light or the like, the surface of the conductive support may be subjected to a cutting, surface roughening or alumite treatment.

In the electrophotographic photosensitive member according to the present invention, a conductive layer having conductive particles and a resin may be provided on the support. The conductive layer is a layer obtained by using a conductive-layer coating solution in which conductive particles are dispersed in a binder resin.

The conductive particles include carbon black, acetylene black, powders of metals such as aluminum, nickel, iron, nichrome, copper, zinc and silver, and powders of metal oxides such as conductive tin oxide and ITO.

The binder resin to be used for the conductive layer includes a polyester resin, a polycarbonate resin, polyvinylbutyral, an acrylic resin, a silicone resin, an epoxy resin, a melamine resin, a urethane resin, a phenol resin and an alkyd resin.

The solvent for the conductive-layer coating solution includes an ether-type solvent, an alcohol-type solvent, a ketone-type solvent and an aromatic hydrocarbon solvent. The film thickness of the conductive layer is preferably not less than 0.2 μm and 40 μm or less, more preferably not less than 1 μm and not more than 35 μm, and still more preferably not less than 5 μm and not more than 30 μm.

An intermediate layer may be provided between the conductive support or the conductive layer and the photosensitive layer. The intermediate layer is formed for improving the adhesion properties of the photosensitive layer, coating properties, and charge injection properties from the conductive support, and protecting the photosensitive layer against electric fracture.

The intermediate layer can be formed by applying an intermediate-layer coating solution containing a binder resin on the conductive support or the conductive layer, and drying or curing the resultant.

The binder resin of the intermediate layer includes polyacrylic acids, methylcellulose, ethylcellulose, a polyamide resin, a polyimide resin, a polyamideimide resin, a polyamide acid resin, a melamine resin, an epoxy resin and a polyurethane resin. The binder resin to be used for the intermediate layer can be a thermoplastic resin, and can be specifically a thermoplastic polyamide resin. The polyamide resin can be a low crystalline or non-crystalline copolymerized nylon so as to be applied in the state of a solution.

The solvent for the intermediate-layer coating solution includes an ether-type solvent, an alcohol-type solvent, a ketone-type solvent and an aromatic hydrocarbon solvent. The film thickness of the intermediate layer is preferably not less than 0.05 μm and not more than 40 μm, and more preferably not less than 0.1 μm and not more than 30 μm. The intermediate layer may contain semi-conductive particles or an electron transport substance, or an electron-accepting substance.

<Photosensitive Layer>

The photosensitive layer (charge generation layer, charge transport layer) is formed on the conductive support, the conductive layer or the intermediate layer.

The charge generation substance to be used for the electrophotographic photosensitive member according to the present invention includes an azo pigment, a phthalocyanine pigment, an indigo pigment and a perylene pigment. One or two or more of such charge generation substances may be used. Among them, oxytitanium phthalocyanine, hydroxygallium phthalocyanine and chlorogallium phthalocyanine are particularly preferable because of a high sensitivity.

The binder resin to be used for the charge generation layer includes a polycarbonate resin, a polyester resin, a butyral resin, a polyvinylacetal resin, an acrylic resin, a vinyl acetate resin and a urea resin. Among them, a butyral resin is particularly preferable. One or two or more of the above resins can be used alone, can be mixed, or can be used as a copolymer.

The charge generation layer can be formed by applying an charge generation-layer coating solution obtained by dispersing a charge generation substance along with a binder resin and a solvent and drying the resultant. The charge generation layer may be a film formed by vapor depositing the charge generation substance.

Examples of a dispersing method includes a method using a homogenizer, an ultrasonic wave, a ball mill, a sand mill, an attritor or a roll mill.

With respect to the proportion of the charge generation substance to the binder resin, the proportion of the charge generation substance is preferably within a range of not less than 0.1 parts by mass and not more than 10 parts by mass, and more preferably not less than 1 part by mass and not more than 3 parts by mass, relative to 1 part by mass of the resin.

The solvent to be used for the charge generation-layer coating solution includes an alcohol-type solvent, a sulfoxide-type solvent, a ketone-type solvent, an ether-type solvent, an ester-type solvent or an aromatic hydrocarbon solvent.

The film thickness of the charge generation layer is preferably not less than 0.01 μm and not more than 5 μm, and more preferably not less than 0.1 μm and not more than 2 μm.

A variety of sensitizers, antioxidants, ultraviolet absorbers plasticizers and the like can also be added to the charge generation layer where necessary. In order not to interrupt the flow of a charge (carrier) in the charge generation layer, the charge generation layer may contain the electron transport substance and the electron-accepting substance.

In the electrophotographic photosensitive member including the laminate type photosensitive layer, the charge transport layer is provided on the charge generation layer.

The charge transport substance to be used in the present invention includes a triarylamine compound, a hydrazone compound, a styryl compound and a stilbene compound. The charge transport substance can be any of compounds represented by the following structural formulas (CTM-1) to (CTM-7).

(CTM-1)

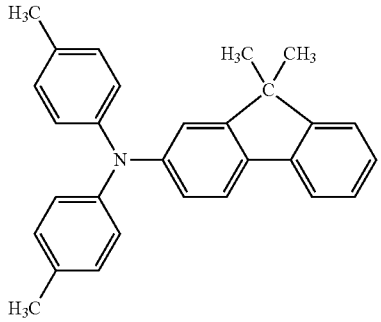

-continued (CTM-2)

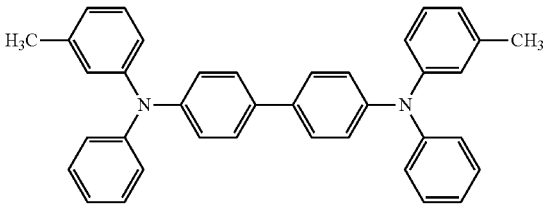

(CTM-3)

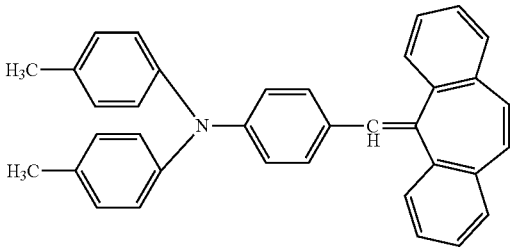

(CTM-4)

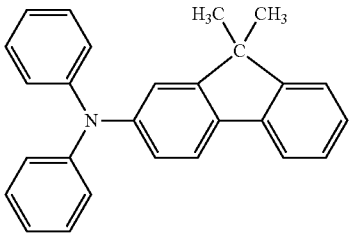

(CTM-5)

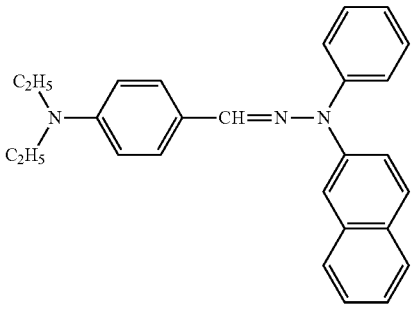

(CTM-6)

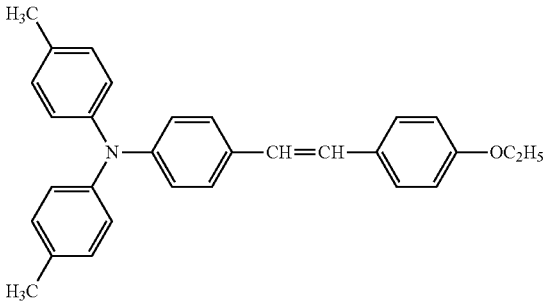

-continued (CTM-7)

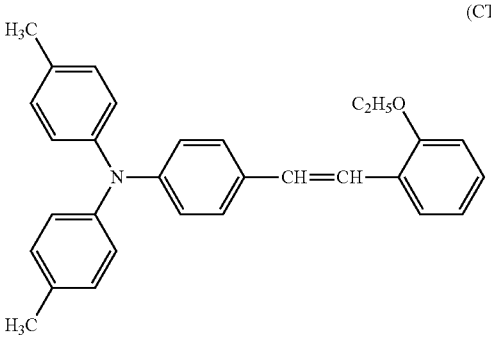

The charge transport layer can be formed by applying the charge transport-layer coating solution obtained by dissolving the charge transport substance and the binder resin in the solvent, and drying the resultant.

In the present invention, when the charge transport layer is the surface layer, the binder resin containing the resin α and the resin β is used, and may be used while being further mixed with other resin. Such other resin to be mixed that may be used is described above.

In the case where the surface layer of the electrophotographic photosensitive member of the present invention is a charge transport layer, a charge transport-layer coating solution (surface-layer coating solution) includes the solvent γ and the compound δ, and may further include other solvent as described above.

With respect to the proportion of the charge transport substance to the binder resin, the proportion of the charge transport substance is preferably not less than 0.3 parts by mass and not more than 2 parts by mass, and more preferably not less than 0.5 parts by mass and not more than 1.5 parts by mass, per part by mass of the binder resin.

The film thickness of the charge transport layer is not less than 5 μm and not more than 50 μm, and more preferably not less than 10 μm and not more than 35 μm.

A variety of additives may be added to the respective layers of the electrophotographic photosensitive member according to the present invention. Examples of the additives include degradation inhibitors such as an antioxidant, an ultraviolet absorber and a light stabilizer, and fine particles such as organic fine particles and inorganic fine particles.

The degradation inhibitors include hindered phenol-type antioxidants, hindered amine-type light stabilizers, sulfur atom-containing antioxidants and phosphorus atom-containing antioxidants.

The organic fine particles include fluorine atom-containing resin particles, and polymer resin particles such as polystyrene fine particles and polyethylene resin particles. Examples of the inorganic fine particles include metal oxides such as silica and alumina.

When the above respective layer coating solutions are applied, any coating method such as a dip coating method, a spray coating method, a spinner coating method, a roller coating method, a Meyer bar coating method and a blade coating method can be used. Among the methods, a dip coating method can be used.

The drying temperature for drying the above respective layer coating solutions to form the respective coats can be 60° C. or higher and 160° C. or lower. Among them, the drying temperature for drying the charge transport-layer coating solution (surface-layer coating solution) can be particularly not lower than 110° C. and not higher than 140° C.

[Electrophotographic Apparatus]

FIGURE illustrates one example of a schematic structure of an electrophotographic apparatus provided with a process cartridge having the electrophotographic photosensitive member according to the present invention.

In FIGURE, reference number 1 denotes a cylindrical electrophotographic photosensitive member, which is rotatably driven at a predetermined circumferential speed around an axis 2 in the direction shown by an arrow. The surface of the electrophotographic photosensitive member 1 to be rotatably driven is uniformly charged to a predetermined negative potential by a charging device (primary charging device: charging roller or the like) 3 in the course of rotation. Then, the charged electrophotographic photosensitive member is subjected to exposure light (image exposure light) 4 which is emitted from an exposure device (not illustrated) such as a slit exposure device or a laser beam scanning exposure device and whose intensity has been modulated according to the time-series electric digital image signal of the intended image information. In this way, an electrostatic latent image according to the intended image is sequentially formed on the surface of the electrophotographic photosensitive member 1.

The electrostatic latent image formed on the surface of the electrophotographic photosensitive member 1 is developed with a toner contained in a developer of a developing device 5 by reverse developing to be formed into a toner image. Then, the toner image formed and supported on the surface of the electrophotographic photosensitive member 1 is sequentially transferred to a transfer material (paper or the like) P with a transfer bias from a transferring device (transfer roller or the like) 6. Herein, the transfer material P is taken out from a transfer material feed device (not illustrated) in synchronous with the rotation of the electrophotographic photosensitive member 1, and fed to a portion (abutting portion) between the electrophotographic photosensitive member 1 and the transferring device 6. A bias voltage having a polarity opposite to the polarity of the charge possessed by the toner is applied to the transferring device 6 from a bias supply (not illustrated).

The transfer material P to which the toner image is transferred is separated from the surface of the electrophotographic photosensitive member 1 and conveyed to a fixing device 8, and is subjected to a treatment of fixing the toner image and conveyed outside the apparatus as an image-formed material (printed or copied material).

The surface of the electrophotographic photosensitive member 1, on which the toner image is transferred, is cleaned by a cleaning device (cleaning blade or the like) 7 so that a transfer residual developer (post-transfer residual toner) is removed. Then, the surface is subjected to a neutralization treatment with pre-exposure light (not illustrated) from a pre-exposure device (not illustrated), and thereafter repeatedly used for image forming. Herein, when the charging device 3 is a contact charging device using a charging roller or the like as illustrated in FIGURE, such pre-exposing is not necessarily required.

In the present invention, a plurality of constituent elements selected from the electrophotographic photosensitive member 1, the charging device 3, the developing device 5, the transferring device 6, the cleaning device 7 and the like may be accommodated in a container to be integrally supported as a process cartridge. Such a process cartridge may be detachably attachable to the main body of the electrophotographic apparatus such as a copier or a laser beam printer. In FIGURE, the electrophotographic photosensitive member 1, the charging device 3, the developing device 5 and the cleaning device 7 are integrally supported to be formed into a cartridge, and thus set up to a process cartridge 9 detachably attachable to the main body of the electrophotographic apparatus by using a guiding device 10 such as a rail provided in the main body of the electrophotographic apparatus.

EXAMPLE

Hereinafter, the present invention will be described in more detail with reference to specific Examples. It is to be noted that the present invention is not limited to the Examples. Herein, "part(s)" in Examples is meant to be "part(s) by mass".

Example 1

An aluminum cylinder of 30 mm in diameter and 260.5 mm in length was used as a support (conductive support).

Then, 12 parts of $SnO_2$-coated barium sulfate (conductive particles), 3 parts of titanium oxide (pigment for resistance modification), 6 parts of a phenol resin (binder resin), 0.001 parts of silicone oil (leveling agent) and a mixed solvent of 4 parts of methanol and 16 parts of methoxypropanol were used to prepare a conductive-layer coating solution.

The conductive-layer coating solution was applied onto the support by dip coating and cured (heat cured) at 140° C. for 30 minutes to thereby form a conductive layer having a film thickness of 25 μm.

Then, 3 parts of N-methoxymethylated nylon and 3 parts of copolymerized nylon were dissolved in a mixed solvent of 65 parts of methanol and 30 parts of n-butanol to thereby prepare an intermediate-layer coating solution.

The intermediate-layer coating solution was applied onto the conductive layer by dip coating and dried at 100° C. for 10 minutes to thereby form an intermediate layer having a film thickness of 0.7 μm.

Then, 10 parts of hydroxygallium phthalocyanine crystal (charge generation substance) of a crystal form having strong peaks at 7.5°, 9.9°, 16.3°, 18.6°, 25.1° and 28.3° of Bragg angles 2θ±0.2° in CuKα characteristic X-ray diffraction was added to a solution obtained by dissolving 5 parts of a polyvinylbutyral resin (trade name: S-LEC BX-1, produced by Sekisui Chemical Co., Ltd., binder resin) in 250 parts of cyclohexanone. This was dispersed in the solution by means of a sand mill apparatus using glass beads of 1 mm in diameter under an atmosphere of 23±3° C. for 1 hour. After such dispersion, 250 parts of ethyl acetate was added thereto to thereby prepare a charge generation-layer coating solution.

The charge generation-layer coating solution was applied onto the intermediate layer by dip coating and dried at 100° C. for 10 minutes to thereby form a charge generation layer having a film thickness of 0.22 μm.

Then, 5.6 parts of a compound represented by the formula (CTM-1) (charge transport substance), 2.4 parts of a compound represented by the formula (CTM-2) (charge transport substance), and 10 parts of a polycarbonate resin A(1) (resin (A1)) and 0.36 parts of a polycarbonate resin D(1) (resin (D1)) were dissolved in a mixed solvent of 30 parts of o-xylene, 20 parts of dimethoxymethane and 2.5 parts of methyl benzoate, to thereby prepare a charge transport-layer coating solution.

The charge transport-layer coating solution was applied onto the charge generation layer by dip coating to form a coat and the coat was dried at 125° C. for 30 minutes to thereby form a charge transport layer having a film thickness of 15 μm to produce an electrophotographic photosensitive member.

Examples 2 and 3

Each electrophotographic photosensitive member was produced in the same manner as in Example 1 except that the drying temperature in forming the charge transport layer was changed to 115° C. and 135° C., respectively, in Example 1.

Examples 4 and 5

Each electrophotographic photosensitive member was produced in the same manner as in Example 1 except that the film thickness of the charge transport layer was changed to 10 μm and 30 μm, respectively, in Example 1.

Examples 6 to 10

Each electrophotographic photosensitive member was produced in the same manner as in Example 1 except that the solvent γ was changed to each solvent shown in Table 4, in Example 1.

Example 11

An electrophotographic photosensitive member was produced in the same manner as in Example 6 except that dimethoxymethane was changed to tetrahydrofuran (THF) in Example 6.

Example 12

An electrophotographic photosensitive member was produced in the same manner as in Example 1 except that dimethoxymethane was not used and the content of o-xylene was changed to 50 parts in Example 1 as shown in Table 4.

Example 13

An electrophotographic photosensitive member was produced in the same manner as in Example 1 except that the content of o-xylene was changed to 20 parts and the content of dimethoxymethane was changed to 30 parts in Example 1 as shown in Table 4.

Examples 14 to 20

Each electrophotographic photosensitive member was produced in the same manner as in Example 1 except that the compound δ was changed as shown in Table 4, respectively, in Example 1.

Examples 21 and 22

Each electrophotographic photosensitive member was produced in the same manner as in Example 1 except that the content of the resin (D1) was changed as shown in Table 4, respectively, in Example 1.

Examples 23 and 24

Each electrophotographic photosensitive member was produced in the same manner as in Example 1 except that the content of methyl benzoate was changed as shown in Table 4, respectively, in Example 1.

Examples 25 and 26

Each electrophotographic photosensitive member was produced in the same manner as in Example 1 except that the content of the resin (D1) and the content of methyl benzoate were changed as shown in Table 4, respectively, in Example 1.

Examples 27 to 31 and 33 to 86

Each electrophotographic photosensitive member was produced in the same manner as in Example 1 except that the types and contents of the resin α, the resin β, the solvent γ, the compound δ the charge transport substance and other solvent were changed as shown in Tables 4 to 6, respectively, in Example 1.

Example 32

An electrophotographic photosensitive member was produced in the same manner as in Example 1 except that the film thickness of the charge transport layer and the drying temperature during the formation of charge transport layer were changed to 10 μm and 115° C. in Example 31.

Examples 87 and 88

Each electrophotographic photosensitive member was produced in the same manner as in Example 1 except that 0.8 parts of a compound represented by the following formula (AD-1) and 0.2 parts of a compound represented by the following formula (AD-2) were contained as additives, and the types and contents of the resin α, the resin β, the solvent γ, the compound δ and the charge transport substance were changed as shown in Table 6, respectively, in Example 1.

(AD-1)

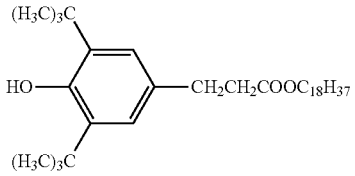

(AD-2)

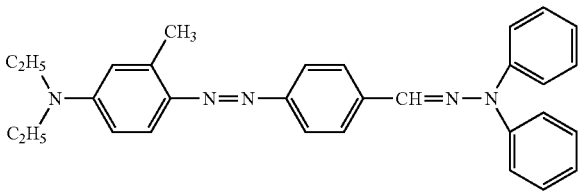

Examples 200 to 203

Each electrophotographic photosensitive member was produced in the same manner as in Example 1 except that the types and contents of the resin α, the resin β, the solvent γ, the compound δ, the charge transport substance and other solvent were changed as shown in Table 6, respectively, in Example 1.

Comparative Examples 1 to 8

Each electrophotographic photosensitive member was produced in the same manner as in Example 1 except that the compound δ was not contained or was changed to monoglyme, diisobutylketone or n-pentyl acetate, and the types and contents of the resin β, the solvent γ and other solvent were changed as shown in Table 7, respectively, in Example 1. Herein, monoglyme, diisobutylketone and n-pentyl acetate are comparative compounds of the compound δ.

Comparative Examples 9 to 27

Each electrophotographic photosensitive member was produced in the same manner as in Example 1 except that the types and contents of the resin α, the resin β, the solvent γ, the compound δ and the charge transport substance were changed as shown in Table 7, respectively, in Example 1.

Comparative Example 28

An electrophotographic photosensitive member was produced in the same manner as in Example 87 except that the compound δ was not contained in Example 87 as shown in Table 7.

Comparative Examples 29 to 31

Each electrophotographic photosensitive member was produced in the same manner as in Example 1 except that, in Example 1, the resin β was changed to dimethylsilicone oil (KF-96-100cs, produced by Shin-Etsu Chemical Co., Ltd.) as shown in Table 7, the compound δ was not contained in Comparative Example 29, and the solvent γ was changed to chlorobenzene (monochlorobenzene) and the compound δ was not contained in Comparative Example 30.

TABLE 4

| Ex- | α | | β | | CTM | | γ | | δ | | Other solvents | |
|---|---|---|---|---|---|---|---|---|---|---|---|---|
| am-ple | Type of resin | Parts by mass | Type of resin | Parts by mass | Structure | Parts by mass | Type | Parts by mass | Type | Parts by mass | Type | Parts by mass |
| 1 | Resin A(1) | 10 | Resin D(1) | 0.36 | CTM-1/ CTM-2 | 5.6/2.4 | o-Xylene | 30 | Methyl benzoate | 2.5 | Dimethoxy methane | 20 |
| 2 | Resin A(1) | 10 | Resin D(1) | 0.36 | CTM-1/ CTM-2 | 5.6/2.4 | o-Xylene | 30 | Methyl benzoate | 2.5 | Dimethoxy methane | 20 |
| 3 | Resin A(1) | 10 | Resin D(1) | 0.36 | CTM-1/ CTM-2 | 5.6/2.4 | o-Xylene | 30 | Methyl benzoate | 2.5 | Dimethoxy methane | 20 |
| 4 | Resin A(1) | 10 | Resin D(1) | 0.36 | CTM-1/ CTM-2 | 5.6/2.4 | o-Xylene | 30 | Methyl benzoate | 2.5 | Dimethoxy methane | 20 |
| 5 | Resin A(1) | 10 | Resin D(1) | 0.36 | CTM-1/ CTM-2 | 5.6/2.4 | o-Xylene | 30 | Methyl benzoate | 2.5 | Dimethoxy methane | 20 |
| 6 | Resin A(1) | 10 | Resin D(1) | 0.36 | CTM-1/ CTM-2 | 5.6/2.4 | Toluene | 30 | Methyl benzoate | 2.5 | Dimethoxy methane | 20 |
| 7 | Resin A(1) | 10 | Resin D(1) | 0.36 | CTM-1/ CTM-2 | 5.6/2.4 | m-Xylene | 30 | Methyl benzoate | 2.5 | Dimethoxy methane | 20 |
| 8 | Resin A(1) | 10 | Resin D(1) | 0.36 | CTM-1/ CTM-2 | 5.6/2.4 | p-Xylene | 30 | Methyl benzoate | 2.5 | Dimethoxy methane | 20 |
| 9 | Resin A(1) | 10 | Resin D(1) | 0.36 | CTM-1/ CTM-2 | 5.6/2.4 | o-Xylene/ Toluene | 15/15 | Methyl benzoate | 2.5 | Dimethoxy methane | 20 |
| 10 | Resin A(1) | 10 | Resin D(1) | 0.36 | CTM-1/ CTM-2 | 5.6/2.4 | Mixed xylene | 30 | Methyl benzoate | 2.5 | Dimethoxy methane | 20 |
| 11 | Resin A(1) | 10 | Resin D(1) | 0.36 | CTM-1/ CTM-2 | 5.6/2.4 | Toluene | 30 | Methyl benzoate | 2.5 | THF | 20 |
| 12 | Resin A(1) | 10 | Resin D(1) | 0.36 | CTM-1/ CTM-2 | 5.6/2.4 | o-Xylene | 50 | Methyl benzoate | 2.5 | — | — |
| 13 | Resin A(1) | 10 | Resin D(1) | 0.36 | CTM-1/ CTM-2 | 5.6/2.4 | o-Xylene | 20 | Methyl benzoate | 2.5 | Dimethoxy methane | 30 |
| 14 | Resin A(1) | 10 | Resin D(1) | 0.36 | CTM-1/ CTM-2 | 5.6/2.4 | o-Xylene | 30 | Ethyl benzoate | 2.5 | Dimethoxy methane | 20 |
| 15 | Resin A(1) | 10 | Resin D(1) | 0.36 | CTM-1/ CTM-2 | 5.6/2.4 | o-Xylene | 30 | Methyl benzoate/ Ethyl benzoate | 1.5/1 | Dimethoxy methane | 20 |
| 16 | Resin A(1) | 10 | Resin D(1) | 0.36 | CTM-1/ CTM-2 | 5.6/2.4 | o-Xylene | 30 | Benzyl acetate | 2.5 | Dimethoxy methane | 20 |
| 17 | Resin A(1) | 10 | Resin D(1) | 0.36 | CTM-1/ CTM-2 | 5.6/2.4 | o-Xylene | 30 | Ethyl 3-ethoxypropionate | 2.5 | Dimethoxy methane | 20 |
| 18 | Resin A(1) | 10 | Resin D(1) | 0.36 | CTM-1/ CTM-2 | 5.6/2.4 | o-Xylene | 30 | Diethylene glycol ethyl methyl ether | 2.5 | Dimethoxy methane | 20 |
| 19 | Resin A(1) | 10 | Resin D(1) | 0.36 | CTM-1/ CTM-2 | 5.6/2.4 | o-Xylene | 30 | Diethylene glycol dimethyl ether | 2.5 | Dimethoxy methane | 20 |
| 20 | Resin A(1) | 10 | Resin D(1) | 0.36 | CTM-1/ CTM-2 | 5.6/2.4 | o-Xylene | 30 | Diethylene glycol diethyl ether | 2.5 | Dimethoxy methane | 20 |
| 21 | Resin A(1) | 10 | Resin D(1) | 0.01 | CTM-1/ CTM-2 | 5.6/2.4 | o-Xylene | 30 | Methyl benzoate | 2.5 | Dimethoxy methane | 20 |
| 22 | Resin A(1) | 10 | Resin D(1) | 5 | CTM-1/ CTM-2 | 5.6/2.4 | o-Xylene | 30 | Methyl benzoate | 2.5 | Dimethoxy methane | 20 |
| 23 | Resin A(1) | 10 | Resin D(1) | 0.36 | CTM-1/ CTM-2 | 5.6/2.4 | o-Xylene | 30 | Methyl benzoate | 0.5 | Dimethoxy methane | 20 |
| 24 | Resin A(1) | 10 | Resin D(1) | 0.36 | CTM-1/ CTM-2 | 5.6/2.4 | o-Xylene | 28 | Methyl benzoate | 8 | Dimethoxy methane | 18 |
| 25 | Resin A(1) | 10 | Resin D(1) | 0.01 | CTM-1/ CTM-2 | 5.6/2.4 | o-Xylene | 30 | Methyl benzoate | 0.5 | Dimethoxy methane | 20 |
| 26 | Resin A(1) | 10 | Resin D(1) | 5 | CTM-1/ CTM-2 | 5.6/2.4 | o-Xylene | 30 | Methyl benzoate | 0.5 | Dimethoxy methane | 20 |
| 27 | Resin A(1) | 10 | Resin D(2) | 0.36 | CTM-1/ CTM-2 | 5.6/2.4 | o-Xylene | 30 | Methyl benzoate | 2.5 | Dimethoxy methane | 20 |
| 28 | Resin A(1) | 10 | Resin D(3) | 0.36 | CTM-1/ CTM-2 | 5.6/2.4 | o-Xylene | 30 | Methyl benzoate | 2.5 | Dimethoxy methane | 20 |
| 29 | Resin A(1) | 10 | Resin E(1) | 0.36 | CTM-1/ CTM-2 | 5.6/2.4 | o-Xylene | 30 | Methyl benzoate | 2.5 | Dimethoxy methane | 20 |
| 30 | Resin A(1) | 10 | Resin D(4) | 0.36 | CTM-1/ CTM-2 | 5.6/2.4 | o-Xylene | 30 | Methyl benzoate | 2.5 | Dimethoxy methane | 20 |

TABLE 4-continued

| Ex- | α | | β | | CTM | | γ | | δ | | Other solvents | |
|---|---|---|---|---|---|---|---|---|---|---|---|---|
| am-ple | Type of resin | Parts by mass | Type of resin | Parts by mass | Structure | Parts by mass | Type | Parts by mass | Type | Parts by mass | Type | Parts by mass |
| 31 | Resin A(1)/ Resin A(2) | 8/2 | Resin D(1) | 0.36 | CTM-1/ CTM-2 | 5.6/2.4 | o-Xylene | 30 | Methyl benzoate | 2.5 | Dimethoxy methane | 20 |
| 32 | Resin A(1)/ Resin A(2) | 8/2 | Resin D(1) | 0.36 | CTM-1/ CTM-2 | 5.6/2.4 | o-Xylene | 30 | Methyl benzoate | 2.5 | Dimethoxy methane | 20 |
| 33 | Resin A(1)/ Resin A(7) | 9/1 | Resin D(1) | 0.1 | CTM-1/ CTM-2 | 5.6/2.4 | o-Xylene | 30 | Methyl benzoate | 2.5 | Dimethoxy methane | 20 |

TABLE 5

| | α | | β | | CTM | | γ | | δ | | Other solvents | |
|---|---|---|---|---|---|---|---|---|---|---|---|---|
| Example | Type of resin | Parts by mass | Type of resin | Parts by mass | Structure | Parts by mass | Type | Parts by mass | Type | Parts by mass | Type | Parts by mass |
| 34 | Resin A(7) | 10 | Resin D(1) | 0.1 | CTM-1/ CTM-2 | 5.6/2.4 | o-Xylene | 30 | Methyl benzoate | 2.5 | Dimethoxy methane | 20 |
| 35 | Resin A(3) | 10 | Resin D(1) | 0.36 | CTM-1/ CTM-2 | 5.6/2.4 | o-Xylene | 40 | Methyl benzoate | 2.5 | Dimethoxy methane | 30 |
| 36 | Resin A(3) | 10 | Resin D(1) | 0.36 | CTM-1/ CTM-2 | 4/4 | o-Xylene | 40 | Methyl benzoate | 2.5 | Dimethoxy methane | 30 |
| 37 | Resin A(3) | 10 | Resin D(1) | 0.36 | CTM-1/ CTM-3 | 7.2/0.8 | o-Xylene | 40 | Methyl benzoate | 2.5 | Dimethoxy methane | 30 |
| 38 | Resin A(3)/ Resin A(8) | 9/1 | Resin D(1) | 0.1 | CTM-1/ CTM-2 | 5.6/2.4 | o-Xylene | 40 | Methyl benzoate | 2.5 | Dimethoxy methane | 30 |
| 39 | Resin A(3)/ Resin A(8) | 9/1 | Resin D(1) | 0.1 | CTM-1/ CTM-3 | 7.2/0.8 | o-Xylene | 40 | Methyl benzoate | 2.5 | Dimethoxy methane | 30 |
| 40 | Resin A(4) | 10 | Resin D(1) | 0.36 | CTM-1/ CTM-2 | 5.6/2.4 | o-Xylene | 30 | Methyl benzoate | 2.5 | Dimethoxy methane | 20 |
| 41 | Resin A(4) | 10 | Resin D(2) | 0.36 | CTM-1/ CTM-2 | 5.6/2.4 | o-Xylene | 30 | Methyl benzoate | 2.5 | Dimethoxy methane | 20 |
| 42 | Resin A(5) | 10 | Resin D(1) | 0.36 | CTM-1/ CTM-2 | 5.6/2.4 | o-Xylene | 30 | Methyl benzoate | 2.5 | Dimethoxy methane | 20 |
| 43 | Resin A(5) | 10 | Resin D(2) | 0.36 | CTM-1/ CTM-2 | 5.6/2.4 | o-Xylene | 30 | Methyl benzoate | 2.5 | Dimethoxy methane | 20 |
| 44 | Resin B(1) | 10 | Resin D(1) | 0.36 | CTM-1/ CTM-2 | 5.6/2.4 | o-Xylene | 45 | Methyl benzoate | 2.5 | Dimethoxy methane | 30 |
| 45 | Resin B(1) | 10 | Resin D(1) | 0.36 | CTM-1/ CTM-2 | 8.1/0.9 | o-Xylene | 45 | Methyl benzoate | 2.5 | Dimethoxy methane | 30 |
| 46 | Resin B(1) | 10 | Resin D(1) | 0.36 | CTM-1/ CTM-3 | 8.1/0.9 | o-Xylene | 45 | Methyl benzoate | 2.5 | Dimethoxy methane | 30 |
| 47 | Resin B(1) | 10 | Resin D(1) | 0.36 | CTM-1/ CTM-2 | 5.6/2.4 | Toluene | 45 | Methyl benzoate | 2.5 | Dimethoxy methane | 30 |
| 48 | Resin B(1) | 10 | Resin D(1) | 0.36 | CTM-1/ CTM-2 | 5.6/2.4 | m-Xylene | 45 | Methyl benzoate | 2.5 | Dimethoxy methane | 30 |
| 49 | Resin B(1) | 10 | Resin D(1) | 0.36 | CTM-1/ CTM-2 | 5.6/2.4 | p-Xylene | 45 | Methyl benzoate | 2.5 | Dimethoxy methane | 30 |
| 50 | Resin B(1) | 10 | Resin D(1) | 0.36 | CTM-1/ CTM-2 | 5.6/2.4 | o-Xylene/ Toluene | 25/20 | Methyl benzoate | 2.5 | Dimethoxy methane | 30 |
| 51 | Resin B(1) | 10 | Resin D(1) | 0.36 | CTM-1/ CTM-2 | 5.6/2.4 | Toluene | 45 | Methyl benzoate | 2.5 | THF | 30 |
| 52 | Resin B(1) | 10 | Resin D(1) | 0.36 | CTM-1/ CTM-2 | 5.6/2.4 | o-Xylene | 70 | Methyl benzoate | 2.5 | — | — |
| 53 | Resin B(1) | 10 | Resin D(1) | 0.36 | CTM-1/ CTM-2 | 5.6/2.4 | o-Xylene | 30 | Methyl benzoate | 2.5 | Dimethoxy methane | 45 |
| 54 | Resin B(1) | 10 | Resin D(1) | 0.36 | CTM-1/ CTM-2 | 5.6/2.4 | o-Xylene | 45 | Ethyl benzoate | 2.5 | Dimethoxy methane | 30 |
| 55 | Resin B(1) | 10 | Resin D(1) | 0.36 | CTM-1/ CTM-2 | 5.6/2.4 | o-Xylene | 45 | Methyl benzoate/ Ethyl benzoate | 1.5/1 | Dimethoxy methane | 30 |
| 56 | Resin B(1) | 10 | Resin D(1) | 0.36 | CTM-1/ CTM-2 | 5.6/2.4 | o-Xylene | 45 | Benzyl acetate | 2.5 | Dimethoxy methane | 30 |
| 57 | Resin B(1) | 10 | Resin D(1) | 0.36 | CTM-1/ CTM-2 | 5.6/2.4 | o-Xylene | 45 | Ethyl 3-ethoxypropionate | 2.5 | Dimethoxy methane | 30 |
| 58 | Resin B(1) | 10 | Resin D(1) | 0.36 | CTM-1/ CTM-2 | 5.6/2.4 | o-Xylene | 45 | Diethylene glycol ethyl methyl ether | 2.5 | Dimethoxy methane | 30 |
| 59 | Resin B(1) | 10 | Resin D(1) | 0.36 | CTM-1/ CTM-2 | 5.6/2.4 | o-Xylene | 45 | Diethylene glycol dimethyl ether | 2.5 | Dimethoxy methane | 30 |
| 60 | Resin B(1) | 10 | Resin D(1) | 0.36 | CTM-1/ CTM-2 | 5.6/2.4 | o-Xylene | 45 | Diethylene glycol diethyl ether | 2.5 | Dimethoxy methane | 30 |

TABLE 5-continued

| | α | | β | | CTM | | γ | | δ | | Other solvents | |
|---|---|---|---|---|---|---|---|---|---|---|---|---|
| Example | Type of resin | Parts by mass | Type of resin | Parts by mass | Structure | Parts by mass | Type | Parts by mass | Type | Parts by mass | Type | Parts by mass |
| 61 | Resin B(1) | 10 | Resin D(1) | 0.01 | CTM-1/ CTM-2 | 5.6/2.4 | o-Xylene | 45 | Methyl benzoate | 2.5 | Dimethoxy methane | 30 |
| 62 | Resin B(1) | 10 | Resin D(1) | 5 | CTM-1/ CTM-2 | 5.6/2.4 | o-Xylene | 45 | Methyl benzoate | 2.5 | Dimethoxy methane | 30 |
| 63 | Resin B(1) | 10 | Resin D(1) | 0.36 | CTM-1/ CTM-2 | 5.6/2.4 | o-Xylene | 45 | Methyl benzoate | 0.5 | Dimethoxy methane | 30 |
| 64 | Resin B(1) | 10 | Resin D(1) | 0.36 | CTM-1/ CTM-2 | 5.6/2.4 | o-Xylene | 40 | Methyl benzoate | 8 | Dimethoxy methane | 27 |
| 65 | Resin B(1) | 10 | Resin D(1) | 0.01 | CTM-1/ CTM-2 | 5.6/2.4 | o-Xylene | 45 | Methyl benzoate | 0.5 | Dimethoxy methane | 30 |
| 66 | Resin B(1) | 10 | Resin D(1) | 5 | CTM-1/ CTM-2 | 5.6/2.4 | o-Xylene | 45 | Methyl benzoate | 0.5 | Dimethoxy methane | 30 |

TABLE 6

| | α | | β | | CTM | | γ | | δ | | Other solvents | |
|---|---|---|---|---|---|---|---|---|---|---|---|---|
| Example | Type of resin | Parts by mass | Type of resin | Parts by mass | Structure | Parts by mass | Type | Parts by mass | Type | Parts by mass | Type | Parts by mass |
| 67 | Resin B(1) | 10 | Resin D(1)/ Resin D(4) | 0.24/0.12 | CTM-1/ CTM-2 | 5.6/2.4 | o-Xylene | 45 | Methyl benzoate | 2.5 | Dimethoxy methane | 30 |
| 68 | Resin B(1) | 10 | Resin E(1) | 0.36 | CTM-1/ CTM-2 | 5.6/2.4 | o-Xylene | 45 | Methyl benzoate | 2.5 | Dimethoxy methane | 30 |
| 69 | Resin B(2) | 10 | Resin D(1) | 0.36 | CTM-1/ CTM-2 | 5.6/2.4 | o-Xylene | 60 | Methyl benzoate | 2.5 | Dimethoxy methane | 40 |
| 70 | Resin B(2) | 10 | Resin D(1) | 0.36 | CTM-1/ CTM-2 | 5.6/2.4 | Toluene | 60 | Methyl benzoate | 2.5 | Dimethoxy methane | 40 |
| 71 | Resin B(2) | 10 | Resin D(1) | 0.36 | CTM-1/ CTM-2 | 5.6/2.4 | Toluene | 60 | Methyl benzoate | 2.5 | THF | 40 |
| 72 | Resin B(2) | 10 | Resin D(1) | 0.36 | CTM-1/ CTM-2 | 5.6/2.4 | o-Xylene | 60 | Ethyl benzoate | 2.5 | Dimethoxy methane | 40 |
| 73 | Resin B(2) | 10 | Resin D(1) | 0.36 | CTM-1/ CTM-2 | 5.6/2.4 | o-Xylene | 60 | Methyl benzoate/ Ethyl benzoate | 1.5/1 | Dimethoxy methane | 40 |
| 74 | Resin B(2) | 10 | Resin D(1) | 0.36 | CTM-1/ CTM-2 | 5.6/2.4 | o-Xylene | 60 | Benzyl acetate | 2.5 | Dimethoxy methane | 40 |
| 75 | Resin B(2) | 10 | Resin D(1) | 0.36 | CTM-1/ CTM-2 | 5.6/2.4 | o-Xylene | 60 | Ethyl 3-ethoxypropionate | 2.5 | Dimethoxy methane | 40 |
| 76 | Resin B(2) | 10 | Resin D(1) | 0.36 | CTM-1/ CTM-2 | 5.6/2.4 | o-Xylene | 60 | Diethylene glycol ethyl methyl ether | 2.5 | Dimethoxy methane | 40 |
| 77 | Resin B(3) | 10 | Resin D(1) | 0.36 | CTM-1/ CTM-2 | 5.6/2.4 | o-Xylene | 60 | Methyl benzoate | 2.5 | Dimethoxy methane | 40 |
| 78 | Resin B(3) | 10 | Resin D(1) | 0.36 | CTM-1/ CTM-2 | 5.6/2.4 | Toluene | 60 | Methyl benzoate | 2.5 | Dimethoxy methane | 40 |
| 79 | Resin B(3) | 10 | Resin D(1) | 0.36 | CTM-1/ CTM-2 | 5.6/2.4 | Toluene | 60 | Methyl benzoate | 2.5 | THF | 40 |
| 80 | Resin B(3) | 10 | Resin D(1) | 0.36 | CTM-1/ CTM-2 | 5.6/2.4 | o-Xylene | 60 | Ethyl benzoate | 2.5 | Dimethoxy methane | 40 |
| 81 | Resin B(3) | 10 | Resin D(1) | 0.36 | CTM-1/ CTM-2 | 5.6/2.4 | o-Xylene | 60 | Methyl benzoate/ Ethyl benzoate | 1.5/1 | Dimethoxy methane | 40 |
| 82 | Resin B(3) | 10 | Resin D(1) | 0.36 | CTM-1/ CTM-2 | 5.6/2.4 | o-Xylene | 60 | Benzyl acetate | 2.5 | Dimethoxy methane | 40 |
| 83 | Resin B(3) | 10 | Resin D(1) | 0.36 | CTM-1/ CTM-2 | 5.6/2.4 | o-Xylene | 60 | Ethyl 3-ethoxypropionate | 2.5 | Dimethoxy methane | 40 |
| 84 | Resin B(3) | 10 | Resin D(1) | 0.36 | CTM-1/ CTM-2 | 5.6/2.4 | o-Xylene | 60 | Diethylene glycol ethyl methyl ether | 2.5 | Dimethoxy methane | 40 |
| 85 | Resin B(3) | 10 | Resin D(2) | 0.36 | CTM-1/ CTM-2 | 5.6/2.4 | o-Xylene | 60 | Methyl benzoate | 2.5 | Dimethoxy methane | 40 |
| 86 | Resin B(3) | 10 | Resin E(1) | 0.36 | CTM-1/ CTM-2 | 5.6/2.4 | o-Xylene | 60 | Methyl benzoate | 2.5 | Dimethoxy methane | 40 |
| 87 | Resin B(3)/ Resin B(6) | 7/3 | Resin D(1) | 0.36 | CTM-1/ CTM-2 | 5.6/2.4 | o-Xylene | 60 | Methyl benzoate | 2.5 | Dimethoxy methane | 40 |
| 88 | Resin B(3)/ Resin B(6) | 7/3 | Resin D(1) | 0.36 | CTM-6/ CTM-7 | 5.0/2.5 | o-Xylene | 60 | Methyl benzoate | 2.5 | Dimethoxy methane | 40 |
| 200 | Resin A(1) | 10 | Resin D(1) | 0.36 | CTM-1/ CTM-2 | 5.6/2.4 | o-Xylene | 12 | Methyl benzoate | 18 | Dimethoxy methane | 20 |
| 201 | Resin B(1) | 10 | Resin D(1) | 0.36 | CTM-1/ CTM-2 | 5.6/2.4 | o-Xylene | 18 | Methyl benzoate | 27 | Dimethoxy methane | 30 |

TABLE 6-continued

| | α | | β | | CTM | | γ | | δ | | Other solvents | |
|---|---|---|---|---|---|---|---|---|---|---|---|---|
| Example | Type of resin | Parts by mass | Type of resin | Parts by mass | Structure | Parts by mass | Type | Parts by mass | Type | Parts by mass | Type | Parts by mass |
| 202 | Resin A(3)/ Resin A(8) | 10 | Resin D(1) | 0.09 | CTM-1/ CTM-2 | 7.2/0.8 | o-Xylene | 21 | Methyl benzoate | 14 | Dimethoxy methane | 35 |
| 203 | Resin B(1)/ Resin A(3)/ Resin A(8) | 5/4/1 | Resin D(1) | 0.09 | CTM-1/ CTM-2 | 8.1/0.9 | o-Xylene | 22.5 | Methyl benzoate | 15 | Dimethoxy methane | 37.5 |

TABLE 7

| | α | | β | | CTM | | γ | | δ | | Other solvents | |
|---|---|---|---|---|---|---|---|---|---|---|---|---|
| Comparative Example | Type of resin | Parts by mass | Type of resin | Parts by mass | Structure | Parts by mass | Type | Parts by mass | Type | Parts by mass | Type | Parts by mass |
| 1 | Resin A(1) | 10 | Resin D(1) | 0.36 | CTM-1/ CTM-2 | 5.6/2.4 | o-Xylene | 30 | — | — | Dimethoxy methane | 20 |
| 2 | Resin A(1) | 10 | Resin D(1) | 0.36 | CTM-1/ CTM-2 | 5.6/2.4 | Toluene | 30 | — | — | THF | 20 |
| 3 | Resin A(1) | 10 | Resin D(1) | 0.36 | CTM-1/ CTM-2 | 5.6/2.4 | o-Xylene | 50 | — | — | — | — |
| 4 | Resin A(1) | 10 | Resin D(1) | 0.36 | CTM-1/ CTM-2 | 5.6/2.4 | o-Xylene | 30 | Monoglyme | 2.5 | Dimethoxy methane | 20 |
| 5 | Resin A(1) | 10 | Resin D(1) | 0.36 | CTM-1/ CTM-2 | 5.6/2.4 | o-Xylene | 30 | Diisobutyl-ketone | 2.5 | Dimethoxy methane | 20 |
| 6 | Resin A(1) | 10 | Resin D(1) | 0.36 | CTM-1/ CTM-2 | 5.6/2.4 | o-Xylene | 30 | n-Pentyl acetate | 2.5 | Dimethoxy methane | 20 |
| 7 | Resin A(1) | 10 | Resin D(3) | 0.36 | CTM-1/ CTM-2 | 5.6/2.4 | o-Xylene | 30 | — | — | Dimethoxy methane | 20 |
| 8 | Resin A(1) | 10 | Resin D(4) | 0.36 | CTM-1/ CTM-2 | 5.6/2.4 | o-Xylene | 30 | — | — | Dimethoxy methane | 20 |
| 9 | Resin A(1)/ Resin A(2) | 8/2 | Resin D(1) | 0.36 | CTM-1/ CTM-2 | 5.6/2.4 | o-Xylene | 30 | — | — | Dimethoxy methane | 20 |
| 10 | Resin A(1)/ Resin A(7) | 9/1 | Resin D(1) | 0.1 | CTM-1/ CTM-2 | 5.6/2.4 | o-Xylene | 30 | — | — | Dimethoxy methane | 20 |
| 11 | Resin A(7) | 10 | Resin D(1) | 0.1 | CTM-1/ CTM-2 | 5.6/2.4 | o-Xylene | 30 | — | — | Dimethoxy methane | 20 |
| 12 | Resin A(3) | 10 | Resin D(1) | 0.36 | CTM-1/ CTM-2 | 5.6/2.4 | o-Xylene | 40 | — | — | Dimethoxy methane | 30 |
| 13 | Resin A(3)/ Resin A(8) | 9/1 | Resin D(1) | 0.1 | CTM-1/ CTM-3 | 7.2/0.8 | o-Xylene | 40 | — | — | Dimethoxy methane | 30 |
| 14 | Resin A(4) | 10 | Resin D(1) | 0.36 | CTM-1/ CTM-2 | 5.6/2.4 | o-Xylene | 30 | — | — | Dimethoxy methane | 20 |
| 15 | Resin A(5) | 10 | Resin D(1) | 0.36 | CTM-1/ CTM-2 | 5.6/2.4 | o-Xylene | 30 | — | — | Dimethoxy methane | 20 |
| 16 | Resin B(1) | 10 | Resin D(1) | 0.36 | CTM-1/ CTM-2 | 5.6/2.4 | o-Xylene | 45 | — | — | Dimethoxy methane | 30 |
| 17 | Resin B(1) | 10 | Resin D(1) | 0.36 | CTM-1/ CTM-2 | 5.6/2.4 | Toluene | 45 | — | — | THF | 30 |
| 18 | Resin B(1) | 10 | Resin D(1) | 0.36 | CTM-1/ CTM-2 | 5.6/2.4 | o-Xylene | 70 | — | — | — | — |
| 19 | Resin B(1) | 10 | Resin D(1) | 0.36 | CTM-1/ CTM-2 | 5.6/2.4 | o-Xylene | 45 | Monoglyme | 2.5 | Dimethoxy methane | 30 |
| 20 | Resin B(1) | 10 | Resin D(1) | 0.36 | CTM-1/ CTM-2 | 5.6/2.4 | o-Xylene | 45 | Diisobutyl-ketone | 2.5 | Dimethoxy methane | 30 |
| 21 | Resin B(1) | 10 | Resin D(1) | 0.36 | CTM-1/ CTM-2 | 5.6/2.4 | o-Xylene | 45 | n-Pentyl acetate | 2.5 | Dimethoxy methane | 30 |
| 22 | Resin B(2) | 10 | Resin D(1) | 0.36 | CTM-1/ CTM-2 | 5.6/2.4 | o-Xylene | 60 | — | — | Dimethoxy methane | 40 |
| 23 | Resin B(3) | 10 | Resin D(1) | 0.36 | CTM-1/ CTM-2 | 5.6/2.4 | o-Xylene | 60 | — | — | Dimethoxy methane | 40 |
| 24 | Resin B(3) | 10 | Resin D(1) | 0.36 | CTM-1/ CTM-2 | 5.6/2.4 | Toluene | 60 | — | — | THF | 40 |
| 25 | Resin B(3) | 10 | Resin D(1) | 0.36 | CTM-1/ CTM-2 | 5.6/2.4 | o-Xylene | 60 | Monoglyme | 2.5 | Dimethoxy methane | 40 |
| 26 | Resin B(3) | 10 | Resin D(1) | 0.36 | CTM-1/ CTM-2 | 5.6/2.4 | o-Xylene | 60 | Diisobutyl-ketone | 2.5 | Dimethoxy methane | 40 |
| 27 | Resin B(3) | 10 | Resin D(1) | 0.36 | CTM-1/ CTM-2 | 5.6/2.4 | o-Xylene | 60 | n-Pentyl acetate | 2.5 | Dimethoxy methane | 40 |
| 28 | Resin B(3)/ Resin A(6) | 7/3 | Resin D(1) | 0.36 | CTM-1/ CTM-2 | 5.6/2.4 | o-Xylene | 60 | — | — | Dimethoxy methane | 40 |

TABLE 7-continued

| | α | | β | | CTM | | γ | | δ | | Other solvents | |
|---|---|---|---|---|---|---|---|---|---|---|---|---|
| Comparative Example | Type of resin | Parts by mass | Type of resin | Parts by mass | Structure | Parts by mass | Type | Parts by mass | Type | Parts by mass | Type | Parts by mass |
| 29 | Resin A(1) | 10 | KF-96-100cs | 0.36 | CTM-1/ CTM-2 | 5.6/2.4 | o-Xylene | 30 | — | — | Dimethoxy methane | 20 |
| 30 | Resin A(1) | 10 | KF-96-100cs | 0.36 | CTM-1/ CTM-2 | 5.6/2.4 | Chlorobenzene | 30 | — | — | Dimethoxy methane | 20 |
| 31 | Resin A(1) | 10 | KF-96-100cs | 0.36 | CTM-1/ CTM-2 | 5.6/2.4 | o-Xylene | 30 | Methyl benzoate | 2.5 | Dimethoxy methane | 20 |

Examples 89 to 168

Each electrophotographic photosensitive member was produced in the same manner as in Example 1 except that the types and contents of the resin α, the resin β, the solvent γ, the compound δ, the charge transport substance and the other solvent were changed as shown in Tables 8-10, respectively, in Example 1.

Examples 169 to 170

Each electrophotographic photosensitive member was produced in the same manner as in Example 88 except that the types and contents of the resin β and the charge transport substance were changed as shown in Table 10, respectively, in Example 88.

Examples 204 to 207

Each electrophotographic photosensitive member was produced in the same manner as in Example 1 except that the types and contents of the resin α, the resin β, the solvent γ, the compound δ, the charge transport substance and other solvent were changed as shown in Table 10, respectively, in Example 1.

Comparative Examples 32 to 35

Each electrophotographic photosensitive member was produced in the same manner as in Example 89 except that the compound δ was not contained or was changed to monoglyme, diisobutylketone or n-pentyl acetate as shown in Table 11, respectively, in Example 89. Herein, monoglyme, diisobutylketone and n-pentyl acetate are Comparative Compounds of the compound δ.

Comparative Examples 36 to 55

Each electrophotographic photosensitive member was produced in the same manner as in Example 1 except that the types and contents of the resin α, the resin β, the solvent γ, the compound δ and the charge transport substance were changed as shown in Table 11, respectively, in Example 89.

Comparative Example 56

An electrophotographic photosensitive member was produced in the same manner as in Example 169 except that the compound δ was not contained in Example 169 as shown in Table 11.

Comparative Examples 57 to 62

Each electrophotographic photosensitive member was produced in the same manner as in Example 1 except that the compound δ was not contained and the types and contents of the resin α and the resin β were changed as shown in Table 11, respectively, in Example 1.

TABLE 8

| | α | | β | | CTM | | γ | | δ | | Other solvents | |
|---|---|---|---|---|---|---|---|---|---|---|---|---|
| Example | Type of resin | Parts by mass | Type of resin | Parts by mass | Structure | Parts by mass | Type | Parts by mass | Type | Parts by mass | Type | Parts by mass |
| 89 | Resin A(1) | 10 | F-B | 0.18 | CTM-1/ CTM-2 | 5.6/2.4 | o-Xylene | 30 | Methyl benzoate | 2.5 | Dimethoxy methane | 20 |
| 90 | Resin A(1) | 10 | F-B | 0.1 | CTM-5 | 9.5 | o-Xylene | 30 | Methyl benzoate | 2.5 | Dimethoxy methane | 20 |
| 91 | Resin A(1) | 10 | F-B | 0.18 | CTM-1/ CTM-2 | 5.6/2.4 | Toluene | 30 | Methyl benzoate | 2.5 | Dimethoxy methane | 20 |
| 92 | Resin A(1) | 10 | F-B | 0.18 | CTM-1/ CTM-2 | 5.6/2.4 | m-Xylene | 30 | Methyl benzoate | 2.5 | Dimethoxy methane | 20 |
| 93 | Resin A(1) | 10 | F-B | 0.18 | CTM-1/ CTM-2 | 5.6/2.4 | p-Xylene | 30 | Methyl benzoate | 2.5 | Dimethoxy methane | 20 |
| 94 | Resin A(1) | 10 | F-B | 0.18 | CTM-1/ CTM-2 | 5.6/2.4 | o-Xylene/ Toluene | 15/15 | Methyl benzoate | 2.5 | Dimethoxy methane | 20 |
| 95 | Resin A(1) | 10 | F-B | 0.18 | CTM-1/ CTM-2 | 5.6/2.4 | Toluene | 30 | Methyl benzoate | 2.5 | THF | 20 |
| 96 | Resin A(1) | 10 | F-B | 0.18 | CTM-1/ CTM-2 | 5.6/2.4 | o-Xylene | 50 | Methyl benzoate | 2.5 | — | — |
| 97 | Resin A(1) | 10 | F-B | 0.18 | CTM-1/ CTM-2 | 5.6/2.4 | o-Xylene | 20 | Methyl benzoate | 2.5 | Dimethoxy methane | 30 |
| 98 | Resin A(1) | 10 | F-B | 0.18 | CTM-1/ CTM-2 | 5.6/2.4 | o-Xylene | 30 | Ethyl benzoate | 2.5 | Dimethoxy methane | 20 |

TABLE 8-continued

| | α | | β | | CTM | | γ | | δ | | Other solvents | |
|---|---|---|---|---|---|---|---|---|---|---|---|---|
| Example | Type of resin | Parts by mass | Type of resin | Parts by mass | Structure | Parts by mass | Type | Parts by mass | Type | Parts by mass | Type | Parts by mass |
| 99 | Resin A(1) | 10 | F-B | 0.18 | CTM-1/ CTM-2 | 5.6/2.4 | o-Xylene | 30 | Methyl benzoate/ Ethyl benzoate | 1.5/1 | Dimethoxy methane | 20 |
| 100 | Resin A(1) | 10 | F-B | 0.18 | CTM-1/ CTM-2 | 5.6/2.4 | o-Xylene | 30 | Benzyl acetate | 2.5 | Dimethoxy methane | 20 |
| 101 | Resin A(1) | 10 | F-B | 0.18 | CTM-1/ CTM-2 | 5.6/2.4 | o-Xylene | 30 | Ethyl 3-ethoxypropionate | 2.5 | Dimethoxy methane | 20 |
| 102 | Resin A(1) | 10 | F-B | 0.18 | CTM-1 / CTM-2 | 5.6/2.4 | o-Xylene | 30 | Diethylene glycol ethyl methyl ether | 2.5 | Dimethoxy methane | 20 |
| 103 | Resin A(1) | 10 | F-B | 0.18 | CTM-1/ CTM-2 | 5.6/2.4 | o-Xylene | 30 | Diethylene glycol dimethyl ether | 2.5 | Dimethoxy methane | 20 |
| 104 | Resin A(1) | 10 | F-B | 0.18 | CTM-1/ CTM-2 | 5.6/2.4 | o-Xylene | 30 | Diethylene glycol diethyl ether | 2.5 | Dimethoxy methane | 20 |
| 105 | Resin A(1) | 10 | F-B | 0.01 | CTM-1/ CTM-2 | 5.6/2.4 | o-Xylene | 30 | Methyl benzoate | 2.5 | Dimethoxy methane | 20 |
| 106 | Resin A(1) | 10 | F-B | 5 | CTM-1/ CTM-2 | 5.6/2.4 | o-Xylene | 30 | Methyl benzoate | 2.5 | Dimethoxy methane | 20 |
| 107 | Resin A(1) | 10 | F-B | 0.18 | CTM-1/ CTM-2 | 5.6/2.4 | o-Xylene | 30 | Methyl benzoate | 0.5 | Dimethoxy methane | 20 |
| 108 | Resin A(1) | 10 | F-B | 0.18 | CTM-1/ CTM-2 | 5.6/2.4 | o-Xylene | 28 | Methyl benzoate | 8 | Dimethoxy methane | 18 |
| 109 | Resin A(1) | 10 | F-B | 0.01 | CTM-1/ CTM-2 | 5.6/2.4 | o-Xylene | 30 | Methyl benzoate | 0.5 | Dimethoxy methane | 20 |
| 110 | Resin A(1) | 10 | F-B | 5 | CTM-1/ CTM-2 | 5.6/2.4 | o-Xylene | 30 | Methyl benzoate | 0.5 | Dimethoxy methane | 20 |
| 111 | Resin A(1) | 10 | F-D | 0.18 | CTM-1/ CTM-2 | 5.6/2.4 | o-Xylene | 30 | Methyl benzoate | 2.5 | Dimethoxy methane | 20 |
| 112 | Resin A(1)/ Resin A(7) | 9.5/0.5 | F-B | 0.18 | CTM-1/ CTM-2 | 5.6/2.4 | o-Xylene | 30 | Methyl benzoate | 2.5 | Dimethoxy methane | 20 |
| 113 | Resin A(1)/ Resin A(7) | 9.5/0.5 | F-B | 0.18 | CTM-1/ CTM-3 | 7.2/0.8 | o-Xylene | 30 | Methyl benzoate | 2.5 | Dimethoxy methane | 20 |
| 114 | Resin A(1)/ Resin A(7) | 9.5/0.5 | F-B | 0.18 | CTM-1/ CTM-4 | 5.6/2.4 | m-Xylene | 30 | Methyl benzoate | 2.5 | Dimethoxy methane | 20 |
| 115 | Resin A(1)/ Resin A(7)/ Resin A(9) | 8.5/0.5/1 | F-B | 0.18 | CTM-1/ CTM-2 | 5.6/2.4 | o-Xylene | 30 | Methyl benzoate | 2.5 | Dimethoxy methane | 20 |
| 116 | Resin A(1)/ Resin A(7)/ Resin A(9) | 8.5/0.5/1 | F-B | 0.18 | CTM-1/ CTM-3 | 7.2/0.8 | o-Xylene | 30 | Methyl benzoate | 2.5 | Dimethoxy methane | 20 |
| 117 | Resin A(3)/ Resin A(8)/ Resin A(9) | 8.5/0.5/1 | F-B | 0.18 | CTM-1/ CTM-2 | 5.6/2.4 | o-Xylene | 40 | Methyl benzoate | 2.5 | Dimethoxy methane | 30 |
| 118 | Resin A(3)/ Resin A(8)/ Resin A(9) | 8.5/0.5/1 | F-B | 0.18 | CTM-1/ CTM-3 | 7.2/0.8 | o-Xylene | 40 | Methyl benzoate | 2.5 | Dimethoxy methane | 30 |
| 119 | Resin A(4) | 10 | F-B | 0.18 | CTM-1/ CTM-2 | 5.6/2.4 | o-Xylene | 30 | Methyl benzoate | 2.5 | Dimethoxy methane | 20 |

TABLE 9

| | α | | β | | CTM | | γ | | δ | | Other solvents | |
|---|---|---|---|---|---|---|---|---|---|---|---|---|
| Example | Type of resin | Parts by mass | Type of resin | Parts by mass | Structure | Parts by mass | Type | Parts by mass | Type | Parts by mass | Type | Parts by mass |
| 120 | Resin A(4) | 10 | F-D | 0.18 | CTM-1/ CTM-2 | 5.6/2.4 | o-Xylene | 30 | Methyl benzoate | 2.5 | Dimethoxy methane | 20 |
| 121 | Resin A(5) | 10 | F-B | 0.18 | CTM-1/ CTM-2 | 5.6/2.4 | o-Xylene | 30 | Methyl benzoate | 2.5 | Dimethoxy methane | 20 |
| 122 | Resin A(5) | 10 | F-D | 0.18 | CTM-1/ CTM-2 | 5.6/2.4 | o-Xylene | 30 | Methyl benzoate | 2.5 | Dimethoxy methane | 20 |
| 123 | Resin B(1) | 10 | F-B | 0.18 | CTM-1/ CTM-2 | 5.6/2.4 | o-Xylene | 45 | Methyl benzoate | 2.5 | Dimethoxy methane | 30 |
| 124 | Resin B(1) | 10 | F-B | 0.18 | CTM-1/ CTM-3 | 8.1/0.9 | o-Xylene | 45 | Methyl benzoate | 2.5 | Dimethoxy methane | 30 |
| 125 | Resin B(1) | 10 | F-B | 0.18 | CTM-1/ CTM-2 | 5.6/2.4 | Toluene | 45 | Methyl benzoate | 2.5 | Dimethoxy methane | 30 |
| 126 | Resin B(1) | 10 | F-B | 0.18 | CTM-1/ CTM-2 | 5.6/2.4 | m-Xylene | 45 | Methyl benzoate | 2.5 | Dimethoxy methane | 30 |
| 127 | Resin B(1) | 10 | F-B | 0.18 | CTM-1/ CTM-2 | 5.6/2.4 | p-Xylene | 45 | Methyl benzoate | 2.5 | Dimethoxy methane | 30 |

TABLE 9-continued

| | α | | β | | CTM | | γ | | δ | | Other solvents | |
|---|---|---|---|---|---|---|---|---|---|---|---|---|
| Example | Type of resin | Parts by mass | Type of resin | Parts by mass | Structure | Parts by mass | Type | Parts by mass | Type | Parts by mass | Type | Parts by mass |
| 128 | Resin B(1) | 10 | F-B | 0.18 | CTM-1/ CTM-2 | 5.6/2.4 | o-Xylene/ Toluene | 25/20 | Methyl benzoate | 2.5 | Dimethoxy methane | 30 |
| 129 | Resin B(1) | 10 | F-B | 0.18 | CTM-1/ CTM-2 | 5.6/2.4 | Toluene | 45 | Methyl benzoate | 2.5 | THF | 30 |
| 130 | Resin B(1) | 10 | F-B | 0.18 | CTM-1/ CTM-2 | 5.6/2.4 | o-Xylene | 70 | Methyl benzoate | 2.5 | — | — |
| 131 | Resin B(1) | 10 | F-B | 0.18 | CTM-1/ CTM-2 | 5.6/2.4 | o-Xylene | 30 | Methyl benzoate | 2.5 | Dimethoxy methane | 45 |
| 132 | Resin B(1) | 10 | F-B | 0.18 | CTM-1/ CTM-2 | 5.6/2.4 | o-Xylene | 45 | Ethyl benzoate | 2.5 | Dimethoxy methane | 30 |
| 133 | Resin B(1) | 10 | F-B | 0.18 | CTM-1/ CTM-2 | 5.6/2.4 | o-Xylene | 45 | Methyl benzoate/ Ethyl benzoate | 1.5/1 | Dimethoxy methane | 30 |
| 134 | Resin B(1) | 10 | F-B | 0.18 | CTM-1/ CTM-2 | 5.6/2.4 | o-Xylene | 45 | Benzyl acetate | 2.5 | Dimethoxy methane | 30 |
| 135 | Resin B(1) | 10 | F-B | 0.18 | CTM-1/ CTM-2 | 5.6/2.4 | o-Xylene | 45 | Ethyl 3-ethoxypropionate | 2.5 | Dimethoxy methane | 30 |
| 136 | Resin B(1) | 10 | F-B | 0.18 | CTM-1/ CTM-2 | 5.6/2.4 | o-Xylene | 45 | Diethylene glycol ethyl methyl ether | 2.5 | Dimethoxy methane | 30 |
| 137 | Resin B(1) | 10 | F-B | 0.18 | CTM-1/ CTM-2 | 5.6/2.4 | o-Xylene | 45 | Diethylene glycol dimethyl ether | 2.5 | Dimethoxy methane | 30 |
| 138 | Resin B(1) | 10 | F-B | 0.18 | CTM-1/ CTM-2 | 5.6/2.4 | o-Xylene | 45 | Diethylene glycol diethyl ether | 2.5 | Dimethoxy methane | 30 |
| 139 | Resin B(1) | 10 | F-B | 0.01 | CTM-1/ CTM-2 | 5.6/2.4 | o-Xylene | 45 | Methyl benzoate | 2.5 | Dimethoxy methane | 30 |
| 140 | Resin B(1) | 10 | F-B | 5 | CTM-1/ CTM-2 | 5.6/2.4 | o-Xylene | 45 | Methyl benzoate | 2.5 | Dimethoxy methane | 30 |
| 141 | Resin B(1) | 10 | F-B | 0.18 | CTM-1/ CTM-2 | 5.6/2.4 | o-Xylene | 45 | Methyl benzoate | 0.5 | Dimethoxy methane | 30 |
| 142 | Resin B(1) | 10 | F-B | 0.18 | CTM-1/ CTM-2 | 5.6/2.4 | o-Xylene | 40 | Methyl benzoate | 8 | Dimethoxy methane | 27 |
| 143 | Resin B(1) | 10 | F-B | 0.01 | CTM-1/ CTM-2 | 5.6/2.4 | o-Xylene | 45 | Methyl benzoate | 0.5 | Dimethoxy methane | 30 |
| 144 | Resin B(1) | 10 | F-B | 5 | CTM-1/ CTM-2 | 5.6/2.4 | o-Xylene | 45 | Methyl benzoate | 0.5 | Dimethoxy methane | 30 |
| 145 | Resin B(1) | 10 | F-D | 0.18 | CTM-1/ CTM-3 | 5.6/2.4 | o-Xylene | 45 | Methyl benzoate | 2.5 | Dimethoxy methane | 30 |
| 146 | Resin B(1)/ Resin A(1)/ Resin A(8) | 5/4/1 | F-B | 0.18 | CTM-1/ CTM-2 | 5.6/2.4 | o-Xylene | 45 | Methyl benzoate | 2.5 | Dimethoxy methane | 30 |
| 147 | Resin B(1)/ Resin A(1)/ Resin A(8) | 5/4/1 | F-B | 0.18 | CTM-1/ CTM-3 | 8.1/0.9 | o-Xylene | 45 | Methyl benzoate | 2.5 | Dimethoxy methane | 30 |
| 148 | Resin B(1)/ Resin A(3)/ Resin A(8) | 5/4/1 | F-B | 0.18 | CTM-1/ CTM-2 | 5.6/2.4 | o-Xylene | 45 | Methyl benzoate | 2.5 | Dimethoxy methane | 30 |
| 149 | Resin B(1)/ Resin A(3)/ Resin A(8) | 5/4/1 | F-B | 0.18 | CTM-1/ CTM-3 | 8.1/0.9 | o-Xylene | 45 | Methyl benzoate | 2.5 | Dimethoxy methane | 30 |

TABLE 10

| | α | | β | | CTM | | γ | | δ | | Other solvents | |
|---|---|---|---|---|---|---|---|---|---|---|---|---|
| Example | Type of resin | Parts by mass | Type of resin | Parts by mass | Structure | Parts by mass | Type | Parts by mass | Type | Parts by mass | Type | Parts by mass |
| 150 | Resin B(1)/ Resin A(9) | 9.5/0.5 | F-B | 0.18 | CTM-1/ CTM-2 | 5.6/2.4 | o-Xylene | 45 | Methyl benzoate | 2.5 | Dimethoxy methane | 30 |
| 151 | Resin B(1)/ Resin A(9) | 9.5/0.5 | F-B | 0.18 | CTM-1/ CTM-3 | 7.2/0.8 | o-Xylene | 45 | Methyl benzoate | 2.5 | Dimethoxy methane | 30 |
| 152 | Resin B(2) | 10 | F-B | 0.18 | CTM-1/ CTM-2 | 5.6/2.4 | o-Xylene | 60 | Methyl benzoate | 2.5 | Dimethoxy methane | 40 |
| 153 | Resin B(2) | 10 | F-B | 0.18 | CTM-1/ CTM-3 | 7.2/0.8 | o-Xylene | 60 | Methyl benzoate | 2.5 | Dimethoxy methane | 40 |
| 154 | Resin B(2) | 10 | F-B | 0.18 | CTM-1/ CTM-2 | 5.6/2.4 | Toluene | 60 | Methyl benzoate | 2.5 | Dimethoxy methane | 40 |
| 155 | Resin B(2) | 10 | F-B | 0.18 | CTM-1/ CTM-2 | 5.6/2.4 | Toluene | 60 | Methyl benzoate | 2.5 | THF | 40 |
| 156 | Resin B(2) | 10 | F-B | 0.18 | CTM-1/ CTM-2 | 5.6/2.4 | o-Xylene | 60 | Ethyl benzoate | 2.5 | Dimethoxy methane | 40 |

TABLE 10-continued

| | α | | β | | CTM | | γ | | δ | | Other solvents | |
|---|---|---|---|---|---|---|---|---|---|---|---|---|
| Example | Type of resin | Parts by mass | Type of resin | Parts by mass | Structure | Parts by mass | Type | Parts by mass | Type | Parts by mass | Type | Parts by mass |
| 157 | Resin B(2) | 10 | F-B | 0.18 | CTM-1/ CTM-2 | 5.6/2.4 | o-Xylene | 60 | Methyl benzoate/ Ethyl benzoate | 1.5/1 | Dimethoxy methane | 40 |
| 158 | Resin B(2) | 10 | F-B | 0.18 | CTM-1/ CTM-2 | 5.6/2.4 | o-Xylene | 60 | Benzyl acetate | 2.5 | Dimethoxy methane | 40 |
| 159 | Resin B(2) | 10 | F-B | 0.18 | CTM-1/ CTM-2 | 5.6/2.4 | o-Xylene | 60 | Ethyl 3-ethoxypropionate | 2.5 | Dimethoxy methane | 40 |
| 160 | Resin B(2) | 10 | F-B | 0.18 | CTM-1/ CTM-2 | 5.6/2.4 | o-Xylene | 60 | Diethylene glycol ethyl methyl ether | 2.5 | Dimethoxy methane | 40 |
| 161 | Resin B(3) | 10 | F-B | 0.18 | CTM-1/ CTM-2 | 5.6/2.4 | o-Xylene | 60 | Methyl benzoate | 2.5 | Dimethoxy methane | 40 |
| 162 | Resin B(3) | 10 | F-B | 0.18 | CTM-1/ CTM-2 | 5.6/2.4 | Toluene | 60 | Methyl benzoate | 2.5 | Dimethoxy methane | 40 |
| 163 | Resin B(3) | 10 | F-B | 0.18 | CTM-1/ CTM-2 | 5.6/2.4 | Toluene | 60 | Methyl benzoate | 2.5 | THF | 40 |
| 164 | Resin B(3) | 10 | F-B | 0.18 | CTM-1/ CTM-2 | 5.6/2.4 | o-Xylene | 60 | Ethyl benzoate | 2.5 | Dimethoxy methane | 40 |
| 165 | Resin B(3) | 10 | F-B | 0.18 | CTM-1/ CTM-2 | 5.6/2.4 | o-Xylene | 60 | Methyl benzoate/ Ethyl benzoate | 1.5/1 | Dimethoxy methane | 40 |
| 166 | Resin B(3) | 10 | F-B | 0.18 | CTM-1/ CTM-2 | 5.6/2.4 | o-Xylene | 60 | Benzyl acetate | 2.5 | Dimethoxy methane | 40 |
| 167 | Resin B(3) | 10 | F-B | 0.18 | CTM-1/ CTM-2 | 5.6/2.4 | o-Xylene | 60 | Ethyl 3-ethoxypropionate | 2.5 | Dimethoxy methane | 40 |
| 168 | Resin B(3) | 10 | F-B | 0.18 | CTM-1/ CTM-2 | 5.6/2.4 | o-Xylene | 60 | Diethylene glycol ethyl methyl ether | 2.5 | Dimethoxy methane | 40 |
| 169 | Resin B(3)/ Resin A(6) | 7/3 | F-B | 0.18 | CTM-1/ CTM-2 | 5.6/2.4 | o-Xylene | 60 | Methyl benzoate | 2.5 | Dimethoxy methane | 40 |
| 170 | Resin B(3)/ Resin A(6) | 7/3 | F-B | 0.18 | CTM-6/ CTM-7 | 5.0/2.5 | o-Xylene | 60 | Methyl benzoate | 2.5 | Dimethoxy methane | 40 |
| 204 | Resin A(1) | 10 | F-B | 0.18 | CTM-1/ CTM-2 | 5.6/2.4 | o-Xylene | 12 | Methyl benzoate | 18 | Dimethoxy methane | 20 |
| 205 | Resin B(1) | 10 | F-B | 0.18 | CTM-1/ CTM-2 | 5.6/2.4 | o-Xylene | 18 | Methyl benzoate | 27 | Dimethoxy methane | 30 |
| 206 | Resin B(1)/ Resin A(3)/ Resin A(8) | 10 | F-B | 0.19 | CTM-1/ CTM-2 | 8.1/0.9 | o-Xylene | 23 | Methyl benzoate | 15 | Dimethoxy methane | 38 |
| 207 | Resin B(2) | 10 | F-B | 0.18 | CTM-1/ CTM-2 | 7.2/0.8 | o-Xylene | 20 | Methyl benzoate | 30 | Dimethoxy methane | 50 |

TABLE 11

| | α | | β | | CTM | | γ | | δ | | Other solvents | |
|---|---|---|---|---|---|---|---|---|---|---|---|---|
| Comparative Example | Type of resin | Parts by mass | Type of resin | Parts by mass | Structure | Parts by mass | Type | Parts by mass | Type | Parts by mass | Type | Parts by mass |
| 32 | Resin A(1) | 10 | F-B | 0.18 | CTM-1/ CTM-2 | 5.6/2.4 | o-Xylene | 30 | — | — | Dimethoxy methane | 20 |
| 33 | Resin A(1) | 10 | F-B | 0.18 | CTM-1/ CTM-2 | 5.6/2.4 | o-Xylene | 30 | Monoglyme | 2.5 | Dimethoxy methane | 20 |
| 34 | Resin A(1) | 10 | F-B | 0.18 | CTM-1/ CTM-2 | 5.6/2.4 | o-Xylene | 30 | Diisobutylketone | 2.5 | Dimethoxy methane | 20 |
| 35 | Resin A(1) | 10 | F-B | 0.18 | CTM-1/ CTM-2 | 5.6/2.4 | o-Xylene | 30 | n-Pentyl acetate | 2.5 | Dimethoxy methane | 20 |
| 36 | Resin A(1)/ Resin A(7) | 9.5/0.5 | F-B | 0.18 | CTM-1/ CTM-2 | 5.6/2.4 | o-Xylene | 30 | — | — | Dimethoxy methane | 20 |
| 37 | Resin A(1)/ Resin A(7)/ Resin A(9) | 8.5/0.5/1 | F-B | 0.18 | CTM-1/ CTM-2 | 5.6/2.4 | o-Xylene | 30 | — | — | Dimethoxy methane | 20 |
| 38 | Resin A(3)/ Resin A(7)/ Resin A(9) | 8.5/0.5/1 | F-B | 0.18 | CTM-1/ CTM-3 | 7.2/0.8 | o-Xylene | 40 | — | — | Dimethoxy methane | 30 |
| 39 | Resin A(4) | 10 | F-B | 0.18 | CTM-1/ CTM-2 | 5.6/2.4 | o-Xylene | 30 | — | — | Dimethoxy methane | 20 |
| 40 | Resin A(5) | 10 | F-B | 0.18 | CTM-1/ CTM-2 | 5.6/2.4 | o-Xylene | 30 | — | — | Dimethoxy methane | 20 |
| 41 | Resin B(1) | 10 | F-B | 0.18 | CTM-1/ CTM-2 | 5.6/2.4 | o-Xylene | 45 | — | — | Dimethoxy methane | 30 |
| 42 | Resin B(1) | 10 | F-B | 0.18 | CTM-1/ CTM-2 | 5.6/2.4 | Toluene | 45 | — | — | THF | 30 |

TABLE 11-continued

| | α | | β | | CTM | | γ | | δ | | Other solvents | |
|---|---|---|---|---|---|---|---|---|---|---|---|---|
| Comparative Example | Type of resin | Parts by mass | Type of resin | Parts by mass | Structure | Parts by mass | Type | Parts by mass | Type | Parts by mass | Type | Parts by mass |
| 43 | Resin B(1) | 10 | F-B | 0.18 | CTM-1/ CTM-2 | 5.6/2.4 | o-Xylene | 70 | — | — | — | — |
| 44 | Resin B(1) | 10 | F-B | 0.18 | CTM-1/ CTM-2 | 5.6/2.4 | o-Xylene | 45 | Monoglyme | 2.5 | Dimethoxy methane | 30 |
| 45 | Resin B(1) | 10 | F-B | 0.18 | CTM-1/ CTM-2 | 5.6/2.4 | o-Xylene | 45 | Diisobutylketone | 2.5 | Dimethoxy methane | 30 |
| 46 | Resin B(1) | 10 | F-B | 0.18 | CTM-1/ CTM-2 | 5.6/2.4 | o-Xylene | 45 | n-Pentyl acetate | 2.5 | Dimethoxy methane | 30 |
| 47 | Resin B(1)/ Resin A(9) | 9.5/0.5 | F-B | 0.18 | CTM-1/ CTM-3 | 7.2/0.8 | o-Xylene | 45 | — | — | Dimethoxy methane | 30 |
| 48 | Resin B(1)/ Resin A(1)/ Resin A(8) | 5/4/1 | F-B | 0.18 | CTM-1/ CTM-3 | 8.1/0.9 | o-Xylene | 45 | — | — | Dimethoxy methane | 30 |
| 49 | Resin B(1)/ Resin A(3)/ Resin A(8) | 5/4/1 | F-B | 0.18 | CTM-1/ CTM-3 | 8.1/0.9 | o-Xylene | 45 | — | — | Dimethoxy methane | 30 |
| 50 | Resin B(2) | 10 | F-B | 0.18 | CTM-1/ CTM-2 | 5.6/2.4 | o-Xylene | 60 | — | — | Dimethoxy methane | 40 |
| 51 | Resin B(2) | 10 | F-B | 0.18 | CTM-1/ CTM-2 | 5.6/2.4 | Toluene | 60 | — | — | THF | 40 |
| 52 | Resin B(2) | 10 | F-B | 0.18 | CTM-1/ CTM-2 | 5.6/2.4 | o-Xylene | 60 | Monoglyme | 2.5 | Dimethoxy methane | 40 |
| 53 | Resin B(2) | 10 | F-B | 0.18 | CTM-1/ CTM-2 | 5.6/2.4 | o-Xylene | 60 | Diisobutylketone | 2.5 | Dimethoxy methane | 40 |
| 54 | Resin B(2) | 10 | F-B | 0.18 | CTM-1/ CTM-2 | 5.6/2.4 | o-Xylene | 60 | n-Pentyl acetate | 2.5 | Dimethoxy methane | 40 |
| 55 | Resin B(3) | 10 | F-B | 0.18 | CTM-1/ CTM-2 | 5.6/2.4 | o-Xylene | 60 | — | — | Dimethoxy methane | 40 |
| 56 | Resin B(3)/ Resin A(6) | 7/3 | F-B | 0.18 | CTM-1/ CTM-2 | 5.6/2.4 | o-Xylene | 60 | — | — | Dimethoxy methane | 40 |
| 57 | Resin A(1) | 10 | — | — | CTM-1/ CTM-2 | 5.6/2.4 | o-Xylene | 30 | — | — | Dimethoxy methane | 20 |
| 58 | Resin A(1) | 10 | — | — | CTM-1/ CTM-2 | 5.6/2.4 | o-Xylene | 30 | Methyl benzoate | 2.5 | Dimethoxy methane | 20 |
| 59 | Resin A(1)/ Resin A(7) | 9/1 | — | — | CTM-1/ CTM-2 | 5.6/2.4 | o-Xylene | 30 | — | — | Dimethoxy methane | 20 |
| 60 | Resin A(1)/ Resin A(7) | 9/1 | — | — | CTM-1/ CTM-2 | 5.6/2.4 | o-Xylene | 30 | Methyl benzoate | 2.5 | Dimethoxy methane | 20 |
| 61 | Resin A(7) | 10 | — | — | CTM-1/ CTM-2 | 5.6/2.4 | o-Xylene | 30 | — | — | Dimethoxy methane | 20 |
| 62 | Resin A(7) | 10 | — | — | CTM-1/ CTM-2 | 5.6/2.4 | o-Xylene | 30 | Methyl benzoate | 2.5 | Dimethoxy methane | 20 |

Hereinafter, evaluations will be described. The coefficient of kinetic friction of the electrophotographic photosensitive member produced in each of Examples and Comparative Examples was measured by the method described below.

The measurement of the coefficient of kinetic friction was performed by using HEIDON-14 manufactured by SHINTO Scientific Co., Ltd. under a normal temperature and normal humidity environment (23° C./50% RH). A blade (urethane rubber blade) to which a constant load was applied (50 g/cm$^2$) was placed in contact with the electrophotographic photosensitive member. A frictional force exerted between the electrophotographic photosensitive member and the urethane rubber blade was measured when the electrophotographic photosensitive member was parallel translated at a process speed of 50 mm/min. The frictional force was measured as the amount of strain of a strain gauge attached at the side of the urethane rubber blade and converted into a tensile load (force to be applied to the photosensitive member). The coefficient of kinetic friction was obtained from [force to be applied to photosensitive member (frictional force) (gf)]/[load applied to blade (gf)] when the urethane rubber blade was operated. The urethane rubber blade used was a urethane blade (rubber hardness: 67°) manufactured by Hokushin Industry Inc., which was cut into a piece measuring 5 mm×30 mm×2 mm, and the friction coefficient was measured under a load of 50 g/cm$^2$ at an angle of 27° to the with direction of the electrophotographic photosensitive member.

The abundance of silicon elements in the surface of the electrophotographic photosensitive member was measured by using X-ray photoelectron spectroscopy (ESCA). In X-ray photoelectron spectroscopy, the element distribution in the topmost surface of the substance was determined. In the measurement, Quantum 2000 Scanning ESCA Microprobe manufactured by PHI was used.

The obtained coefficient of kinetic friction and the abundance of silicon elements are shown in Tables 12 to 13. The coefficient of kinetic friction in each Examples 1 to 88, in which the polycarbonate resin or the polyester resin was used as the resin β, was determined as the relative value when the coefficient of kinetic friction in Comparative Example 7, in which the resin β was the polycarbonate resin or the polyester resin, was assumed to be 1. Similarly, the coefficient of kinetic friction in each of Comparative Examples 1 to 31 was also determined as the relative value. The coefficient of kinetic friction in each Examples 89 to 170, in which the acrylic resin was used as the resin β, was determined as the relative value when the coefficient of kinetic friction in Comparative Example 54, in which the resin β was the acrylic resin, was assumed to be 1. Similarly, the coefficient of kinetic friction in each of Comparative Examples 32 to 62 was also determined as the relative value.

TABLE 12

| | Ratio between compositions (% by mass) | | | | Relative value of coefficient of | |
|---|---|---|---|---|---|---|
| | δ/α | δ/(α + β) | δ/γ | β/α | kinetic friction (measured value) | Silicon element |
| Example | | | | | | |
| 1 | 25.0% | 24.1% | 8.3% | 3.6% | 0.38 (0.15) | 14.4% |
| 2 | 25.0% | 24.1% | 8.3% | 3.6% | 0.46 (0.18) | 13.4% |
| 3 | 25.0% | 24.1% | 8.3% | 3.6% | 0.38 (0.15) | 14.5% |
| 4 | 25.0% | 24.1% | 8.3% | 3.6% | 0.41 (0.16) | 14.0% |
| 5 | 25.0% | 24.1% | 8.3% | 3.6% | 0.38 (0.15) | 14.4% |
| 6 | 25.0% | 24.1% | 8.3% | 3.6% | 0.41 (0.16) | 14.1% |
| 7 | 25.0% | 24.1% | 8.3% | 3.6% | 0.41 (0.16) | 14.0% |
| 8 | 25.0% | 24.1% | 8.3% | 3.6% | 0.44 (0.17) | 13.7% |
| 9 | 25.0% | 24.1% | 8.3% | 3.6% | 0.41 (0.16) | 14.0% |
| 10 | 25.0% | 24.1% | 8.3% | 3.6% | 0.49 (0.19) | 13.1% |
| 11 | 25.0% | 24.1% | 8.3% | 3.6% | 0.46 (0.18) | 13.3% |
| 12 | 25.0% | 24.1% | 5.0% | 3.6% | 0.46 (0.18) | 13.4% |
| 13 | 25.0% | 24.1% | 12.5% | 3.6% | 0.51 (0.2) | 12.9% |
| 14 | 25.0% | 24.1% | 8.3% | 3.6% | 0.38 (0.15) | 14.4% |
| 15 | 25.0% | 24.1% | 8.3% | 3.6% | 0.38 (0.15) | 14.3% |
| 16 | 25.0% | 24.1% | 8.3% | 3.6% | 0.41 (0.16) | 14.1% |
| 17 | 25.0% | 24.1% | 8.3% | 3.6% | 0.46 (0.18) | 13.5% |
| 18 | 25.0% | 24.1% | 8.3% | 3.6% | 0.49 (0.19) | 13.1% |
| 19 | 25.0% | 24.1% | 8.3% | 3.6% | 0.59 (0.23) | 12.4% |
| 20 | 25.0% | 24.1% | 8.3% | 3.6% | 0.59 (0.23) | 12.4% |
| 21 | 25.0% | 25.0% | 8.3% | 0.1% | 0.62 (0.24) | 12.4% |
| 22 | 25.0% | 16.7% | 8.3% | 50.0% | 0.38 (0.15) | 14.4% |
| 23 | 5.0% | 5.0% | 1.7% | 3.6% | 0.59 (0.23) | 12.4% |
| 24 | 80.0% | 77.2% | 28.6% | 3.6% | 0.46 (0.18) | 13.4% |
| 25 | 5.0% | 5.0% | 1.7% | 0.1% | 0.72 (0.28) | 11.8% |
| 26 | 5.0% | 3.3% | 1.7% | 50.0% | 0.67 (0.26) | 12.0% |
| 27 | 25.0% | 24.1% | 8.3% | 3.6% | 0.51 (0.2) | 12.9% |
| 28 | 25.0% | 24.1% | 8.3% | 3.6% | 0.38 (0.15) | 14.5% |
| 29 | 25.0% | 24.1% | 8.3% | 3.6% | 0.59 (0.23) | 12.5% |
| 30 | 25.0% | 24.1% | 8.3% | 3.6% | 0.82 (0.32) | 11.6% |
| 31 | 25.0% | 24.1% | 8.3% | 3.6% | 0.41 (0.16) | 14.0% |
| 32 | 25.0% | 24.1% | 8.3% | 3.6% | 0.41 (0.16) | 14.1% |
| 33 | 25.0% | 24.1% | 8.3% | 1.0% | 0.51 (0.2) | 12.9% |
| 34 | 25.0% | 24.8% | 8.3% | 1.0% | 0.49 (0.19) | 13.1% |
| 35 | 25.0% | 24.1% | 6.3% | 3.6% | 0.46 (0.18) | 13.4% |
| 36 | 25.0% | 24.1% | 6.3% | 3.6% | 0.46 (0.18) | 13.4% |
| 37 | 25.0% | 24.1% | 6.3% | 3.6% | 0.49 (0.19) | 13.1% |
| 38 | 25.0% | 24.1% | 6.3% | 1.0% | 0.59 (0.23) | 12.4% |
| 39 | 25.0% | 24.1% | 6.3% | 1.0% | 0.62 (0.24) | 12.3% |
| 40 | 25.0% | 24.1% | 8.3% | 3.6% | 0.51 (0.2) | 12.9% |
| 41 | 25.0% | 24.1% | 8.3% | 3.6% | 0.54 (0.21) | 12.6% |
| 42 | 25.0% | 24.1% | 8.3% | 3.6% | 0.51 (0.2) | 12.8% |
| 43 | 25.0% | 24.1% | 8.3% | 3.6% | 0.59 (0.23) | 12.4% |
| 44 | 25.0% | 24.1% | 5.6% | 3.6% | 0.31 (0.12) | 16.2% |
| 45 | 25.0% | 24.1% | 5.6% | 3.6% | 0.31 (0.12) | 16.1% |
| 46 | 25.0% | 24.1% | 5.6% | 3.6% | 0.28 (0.11) | 16.7% |
| 47 | 25.0% | 24.1% | 5.6% | 3.6% | 0.33 (0.13) | 15.5% |
| 48 | 25.0% | 24.1% | 5.6% | 3.6% | 0.33 (0.13) | 15.5% |
| 49 | 25.0% | 24.1% | 5.6% | 3.6% | 0.38 (0.15) | 14.4% |
| 50 | 25.0% | 24.1% | 5.6% | 3.6% | 0.33 (0.13) | 15.5% |
| 51 | 25.0% | 24.1% | 5.6% | 3.6% | 0.41 (0.16) | 14.0% |
| 52 | 25.0% | 24.1% | 3.6% | 3.6% | 0.36 (0.14) | 14.9% |
| 53 | 25.0% | 24.1% | 8.3% | 3.6% | 0.46 (0.18) | 13.3% |
| 54 | 25.0% | 24.1% | 5.6% | 3.6% | 0.31 (0.12) | 16.1% |
| 55 | 25.0% | 24.1% | 5.6% | 3.6% | 0.31 (0.12) | 16.0% |
| 56 | 25.0% | 24.1% | 5.6% | 3.6% | 0.33 (0.13) | 15.5% |
| 57 | 25.0% | 24.1% | 5.6% | 3.6% | 0.31 (0.12) | 16.1% |
| 58 | 25.0% | 24.1% | 5.6% | 3.6% | 0.33 (0.13) | 15.5% |
| 59 | 25.0% | 24.1% | 5.6% | 3.6% | 0.46 (0.18) | 13.4% |
| 60 | 25.0% | 24.1% | 5.6% | 3.6% | 0.49 (0.19) | 13.1% |
| 61 | 25.0% | 25.0% | 5.6% | 0.1% | 0.54 (0.21) | 12.7% |
| 62 | 25.0% | 16.7% | 5.6% | 50.0% | 0.41 (0.16) | 14.0% |
| 63 | 5.0% | 4.8% | 1.1% | 3.6% | 0.46 (0.18) | 13.4% |
| 64 | 80.0% | 77.2% | 20.0% | 3.6% | 0.41 (0.16) | 14.0% |
| 65 | 5.0% | 5.0% | 1.1% | 0.1% | 0.49 (0.19) | 13.2% |
| 66 | 5.0% | 3.3% | 1.1% | 50.0% | 0.46 (0.18) | 13.4% |
| 67 | 25.0% | 24.1% | 5.6% | 3.6% | 0.46 (0.18) | 13.4% |
| 68 | 25.0% | 24.1% | 5.6% | 3.6% | 0.46 (0.18) | 13.5% |
| 69 | 25.0% | 24.1% | 4.2% | 3.6% | 0.41 (0.16) | 14.0% |
| 70 | 25.0% | 24.1% | 4.2% | 3.6% | 0.38 (0.15) | 14.4% |
| 71 | 25.0% | 24.1% | 4.2% | 3.6% | 0.44 (0.17) | 13.7% |
| 72 | 25.0% | 24.1% | 4.2% | 3.6% | 0.38 (0.15) | 14.4% |

TABLE 12-continued

| | Ratio between compositions (% by mass) | | | | Relative value of coefficient of | |
|---|---|---|---|---|---|---|
| | δ/α | δ/(α + β) | δ/γ | β/α | kinetic friction (measured value) | Silicon element |
| 73 | 25.0% | 24.1% | 4.2% | 3.6% | 0.41 (0.16) | 14.0% |
| 74 | 25.0% | 24.1% | 4.2% | 3.6% | 0.41 (0.16) | 14.1% |
| 75 | 25.0% | 24.1% | 4.2% | 3.6% | 0.38 (0.15) | 14.4% |
| 76 | 25.0% | 24.1% | 4.2% | 3.6% | 0.44 (0.17) | 13.7% |
| 77 | 25.0% | 24.1% | 4.2% | 3.6% | 0.46 (0.18) | 13.4% |
| 78 | 25.0% | 24.1% | 4.2% | 3.6% | 0.49 (0.19) | 13.1% |
| 79 | 25.0% | 24.1% | 4.2% | 3.6% | 0.54 (0.21) | 12.7% |
| 80 | 25.0% | 24.1% | 4.2% | 3.6% | 0.49 (0.19) | 13.1% |
| 81 | 25.0% | 24.1% | 4.2% | 3.6% | 0.46 (0.18) | 13.4% |
| 82 | 25.0% | 24.1% | 4.2% | 3.6% | 0.46 (0.18) | 13.4% |
| 83 | 25.0% | 24.1% | 4.2% | 3.6% | 0.49 (0.19) | 13.2% |
| 84 | 25.0% | 24.1% | 4.2% | 3.6% | 0.49 (0.19) | 13.1% |
| 85 | 25.0% | 24.1% | 4.2% | 3.6% | 0.38 (0.15) | 14.4% |
| 86 | 25.0% | 24.1% | 4.2% | 3.6% | 0.36 (0.14) | 14.9% |
| 87 | 25.0% | 24.1% | 4.2% | 3.6% | 0.46 (0.18) | 13.4% |
| 88 | 25.0% | 24.1% | 4.2% | 3.6% | 0.46 (0.18) | 13.4% |
| 200 | 180.0% | 173.7% | 150.0% | 3.6% | 0.38 (0.15) | 14.3% |
| 201 | 270.0% | 260.6% | 150.0% | 3.6% | 0.31 (0.12) | 16.1% |
| 202 | 140.0% | 138.8% | 66.7% | 0.9% | 0.49 (0.19) | 13.0% |
| 203 | 150.0% | 148.7% | 66.7% | 0.9% | 0.44 (0.17) | 13.8% |
| Comparative Example | | | | | | |
| 1 | — | — | — | 3.6% | 1.03 (0.4) | 11.0% |
| 2 | — | — | — | 3.6% | 1.08 (0.42) | 10.9% |
| 3 | — | — | — | 3.6% | 1.03 (0.4) | 11.0% |
| 4 | 25.0% | 24.1% | 8.3% | 3.6% | 1.03 (0.4) | 11.1% |
| 5 | 25.0% | 24.1% | 8.3% | 3.6% | 1.05 (0.41) | 10.9% |
| 6 | 25.0% | 24.1% | 8.3% | 3.6% | 1.08 (0.42) | 10.9% |
| 7 | — | — | — | 3.6% | 1.00 (0.39) | 11.1% |
| 8 | — | — | — | 3.6% | 1.28 (0.5) | 10.4% |
| 9 | — | — | — | 3.6% | 1.00 (0.39) | 11.0% |
| 10 | — | — | — | 1.0% | 1.13 (0.44) | 10.7% |
| 11 | — | — | — | 1.0% | 1.08 (0.42) | 10.9% |
| 12 | — | — | — | 3.6% | 1.15 (0.45) | 10.7% |
| 13 | — | — | — | 0.1% | 1.10 (0.43) | 10.8% |
| 14 | — | — | — | 3.6% | 1.05 (0.41) | 10.9% |
| 15 | — | — | — | 3.6% | 1.08 (0.42) | 10.8% |
| 16 | — | — | — | 3.6% | 1.08 (0.42) | 10.8% |
| 17 | — | — | — | 3.6% | 1.10 (0.43) | 10.7% |
| 18 | — | — | — | 3.6% | 1.05 (0.41) | 10.8% |
| 19 | 25.0% | 24.1% | 5.6% | 3.6% | 1.03 (0.4) | 11.0% |
| 20 | 25.0% | 24.1% | 5.6% | 3.6% | 1.08 (0.42) | 10.9% |
| 21 | 25.0% | 24.1% | 5.6% | 3.6% | 1.13 (0.44) | 10.7% |
| 22 | — | — | — | 3.6% | 1.15 (0.45) | 10.7% |
| 23 | — | — | — | 3.6% | 1.18 (0.46) | 10.6% |
| 24 | — | — | — | 3.6% | 1.13 (0.44) | 10.7% |
| 25 | 25.0% | 24.1% | 4.2% | 3.6% | 1.15 (0.45) | 10.7% |
| 26 | 25.0% | 24.1% | 4.2% | 3.6% | 1.15 (0.45) | 10.6% |
| 27 | 25.0% | 24.1% | 4.2% | 3.6% | 1.18 (0.46) | 10.5% |
| 28 | — | — | — | 3.6% | 1.15 (0.45) | 10.7% |
| 29 | — | — | — | 3.6% | 1.15 (0.45) | 10.6% |
| 30 | — | — | — | 3.6% | 1.15 (0.45) | 10.7% |
| 31 | 25.0% | 24.1% | 8.3% | 3.6% | 1.10 (0.43) | 10.8% |

TABLE 13

| | Ratio between compositions (% by mass) | | | | Relative value of coefficient of | |
|---|---|---|---|---|---|---|
| | δ/α | δ/(α + β) | δ/γ | β/α | kinetic friction (measured value) | Silicon element |
| Example | | | | | | |
| 89 | 25.0% | 24.6% | 8.3% | 1.8% | 0.74 (0.42) | 10.9% |
| 90 | 25.0% | 24.8% | 8.3% | 1.0% | 0.86 (0.49) | 10.5% |
| 91 | 25.0% | 24.6% | 8.3% | 1.8% | 0.77 (0.44) | 10.7% |
| 92 | 25.0% | 24.6% | 8.3% | 1.8% | 0.74 (0.42) | 10.9% |
| 93 | 25.0% | 24.6% | 8.3% | 1.8% | 0.75 (0.43) | 10.8% |
| 94 | 25.0% | 24.6% | 8.3% | 1.8% | 0.77 (0.44) | 10.6% |

TABLE 13-continued

| | Ratio between compositions (% by mass) | | | | Relative value of coefficient of | |
|---|---|---|---|---|---|---|
| | δ/α | δ/(α + β) | δ/γ | β/α | kinetic friction (measured value) | Silicon element |
| 95 | 25.0% | 24.6% | 8.3% | 1.8% | 0.79 (0.45) | 10.7% |
| 96 | 25.0% | 24.6% | 5.0% | 1.8% | 0.82 (0.47) | 10.6% |
| 97 | 25.0% | 24.6% | 12.5% | 1.8% | 0.86 (0.49) | 10.5% |
| 98 | 25.0% | 24.6% | 8.3% | 1.8% | 0.75 (0.43) | 10.8% |
| 99 | 25.0% | 24.6% | 8.3% | 1.8% | 0.72 (0.41) | 10.9% |
| 100 | 25.0% | 24.6% | 8.3% | 1.8% | 0.79 (0.45) | 10.7% |
| 101 | 25.0% | 24.6% | 8.3% | 1.8% | 0.81 (0.46) | 10.6% |
| 102 | 25.0% | 24.6% | 8.3% | 1.8% | 0.82 (0.47) | 10.5% |
| 103 | 25.0% | 24.6% | 8.3% | 1.8% | 0.88 (0.5) | 10.6% |
| 104 | 25.0% | 24.6% | 8.3% | 1.8% | 0.86 (0.49) | 10.5% |
| 105 | 25.0% | 25.0% | 8.3% | 0.1% | 0.89 (0.51) | 10.4% |
| 106 | 25.0% | 16.7% | 8.3% | 50.0% | 0.75 (0.43) | 10.8% |
| 107 | 5.0% | 4.9% | 1.7% | 1.8% | 0.88 (0.5) | 10.4% |
| 108 | 80.0% | 78.6% | 28.6% | 1.8% | 0.75 (0.43) | 10.7% |
| 109 | 5.0% | 5.0% | 1.7% | 0.1% | 0.91 (0.52) | 10.3% |
| 110 | 5.0% | 3.3% | 1.7% | 50.0% | 0.89 (0.51) | 10.4% |
| 111 | 25.0% | 24.6% | 8.3% | 1.8% | 0.81 (0.46) | 10.7% |
| 112 | 25.0% | 24.6% | 8.3% | 1.8% | 0.74 (0.42) | 10.9% |
| 113 | 25.0% | 24.6% | 8.3% | 1.8% | 0.70 (0.4) | 11.0% |
| 114 | 25.0% | 24.6% | 8.3% | 1.8% | 0.70 (0.4) | 11.1% |
| 115 | 25.0% | 24.6% | 8.3% | 1.8% | 0.68 (0.39) | 11.2% |
| 116 | 25.0% | 24.6% | 8.3% | 1.8% | 0.68 (0.39) | 11.0% |
| 117 | 25.0% | 24.6% | 6.3% | 1.8% | 0.72 (0.41) | 10.9% |
| 118 | 25.0% | 24.6% | 6.3% | 1.8% | 0.72 (0.41) | 10.9% |
| 119 | 25.0% | 24.6% | 8.3% | 1.8% | 0.77 (0.44) | 10.7% |
| 120 | 25.0% | 24.6% | 8.3% | 1.8% | 0.75 (0.43) | 10.8% |
| 121 | 25.0% | 24.6% | 8.3% | 1.8% | 0.77 (0.44) | 10.8% |
| 122 | 25.0% | 24.6% | 8.3% | 1.8% | 0.79 (0.45) | 10.7% |
| 123 | 25.0% | 24.6% | 5.6% | 1.8% | 0.67 (0.38) | 11.1% |
| 124 | 25.0% | 24.6% | 5.6% | 1.8% | 0.68 (0.39) | 11.0% |
| 125 | 25.0% | 24.6% | 5.6% | 1.8% | 0.72 (0.41) | 10.9% |
| 126 | 25.0% | 24.6% | 5.6% | 1.8% | 0.72 (0.41) | 10.8% |
| 127 | 25.0% | 24.6% | 5.6% | 1.8% | 0.70 (0.4) | 11.0% |
| 128 | 25.0% | 24.6% | 5.6% | 1.8% | 0.72 (0.41) | 10.9% |
| 129 | 25.0% | 24.6% | 5.6% | 1.8% | 0.74 (0.42) | 10.8% |
| 130 | 25.0% | 24.6% | 3.6% | 1.8% | 0.72 (0.41) | 10.9% |
| 131 | 25.0% | 24.6% | 8.3% | 1.8% | 0.79 (0.45) | 10.7% |
| 132 | 25.0% | 24.6% | 5.6% | 1.8% | 0.72 (0.41) | 10.9% |
| 133 | 25.0% | 24.6% | 5.6% | 1.8% | 0.72 (0.41) | 10.9% |
| 134 | 25.0% | 24.6% | 5.6% | 1.8% | 0.75 (0.43) | 10.8% |
| 135 | 25.0% | 24.6% | 5.6% | 1.8% | 0.67 (0.38) | 11.1% |
| 136 | 25.0% | 24.6% | 5.6% | 1.8% | 0.70 (0.4) | 11.0% |
| 137 | 25.0% | 24.6% | 5.6% | 1.8% | 0.81 (0.46) | 10.6% |
| 138 | 25.0% | 24.6% | 5.6% | 1.8% | 0.79 (0.45) | 10.7% |
| 139 | 25.0% | 25.0% | 5.6% | 0.1% | 0.84 (0.48) | 10.5% |
| 140 | 25.0% | 16.7% | 5.6% | 50.0% | 0.70 (0.4) | 11.0% |
| 141 | 5.0% | 4.9% | 1.1% | 1.8% | 0.74 (0.42) | 10.9% |
| 142 | 80.0% | 78.6% | 20.0% | 1.8% | 0.67 (0.38) | 11.1% |
| 143 | 5.0% | 5.0% | 1.1% | 0.1% | 0.79 (0.45) | 10.7% |
| 144 | 5.0% | 3.3% | 1.1% | 50.0% | 0.75 (0.43) | 10.8% |
| 145 | 25.0% | 24.6% | 5.6% | 1.8% | 0.72 (0.41) | 10.9% |
| 146 | 25.0% | 24.6% | 5.6% | 1.8% | 0.68 (0.39) | 11.0% |
| 147 | 25.0% | 24.6% | 5.6% | 1.8% | 0.67 (0.38) | 11.1% |
| 148 | 25.0% | 24.6% | 5.6% | 1.8% | 0.72 (0.41) | 10.9% |
| 149 | 25.0% | 24.6% | 5.6% | 1.8% | 0.68 (0.39) | 11.0% |
| 150 | 25.0% | 24.6% | 5.6% | 1.8% | 0.68 (0.39) | 11.0% |
| 151 | 25.0% | 24.6% | 5.6% | 1.8% | 0.70 (0.4) | 10.9% |
| 152 | 25.0% | 24.6% | 4.2% | 1.8% | 0.79 (0.45) | 10.7% |
| 153 | 25.0% | 24.6% | 4.2% | 1.8% | 0.75 (0.43) | 10.8% |
| 154 | 25.0% | 24.6% | 4.2% | 1.8% | 0.75 (0.43) | 10.8% |
| 155 | 25.0% | 24.6% | 4.2% | 1.8% | 0.84 (0.48) | 10.5% |
| 156 | 25.0% | 24.6% | 4.2% | 1.8% | 0.75 (0.43) | 10.8% |
| 157 | 25.0% | 24.6% | 4.2% | 1.8% | 0.74 (0.42) | 10.9% |
| 158 | 25.0% | 24.6% | 4.2% | 1.8% | 0.81 (0.46) | 10.6% |
| 159 | 25.0% | 24.6% | 4.2% | 1.8% | 0.79 (0.45) | 10.7% |
| 160 | 25.0% | 24.6% | 4.2% | 1.8% | 0.75 (0.43) | 10.8% |
| 161 | 25.0% | 24.6% | 4.2% | 1.8% | 0.72 (0.41) | 10.9% |
| 162 | 25.0% | 24.6% | 4.2% | 1.8% | 0.74 (0.42) | 10.8% |
| 163 | 25.0% | 24.6% | 4.2% | 1.8% | 0.79 (0.45) | 10.7% |
| 164 | 25.0% | 24.6% | 4.2% | 1.8% | 0.72 (0.41) | 10.9% |
| 165 | 25.0% | 24.6% | 4.2% | 1.8% | 0.74 (0.42) | 10.8% |
| 166 | 25.0% | 24.6% | 4.2% | 1.8% | 0.72 (0.41) | 10.9% |
| 167 | 25.0% | 24.6% | 4.2% | 1.8% | 0.75 (0.43) | 10.8% |
| 168 | 25.0% | 24.6% | 4.2% | 1.8% | 0.79 (0.45) | 10.7% |

TABLE 13-continued

| | Ratio between compositions (% by mass) | | | | Relative value of coefficient of | |
|---|---|---|---|---|---|---|
| | δ/α | δ/(α + β) | δ/γ | β/α | kinetic friction (measured value) | Silicon element |
| 169 | 25.0% | 24.6% | 4.2% | 1.8% | 0.79 (0.45) | 10.7% |
| 170 | 25.0% | 24.6% | 4.2% | 1.8% | 0.81 (0.46) | 10.6% |
| 204 | 180.0% | 176.8% | 150.0% | 1.8% | 0.70 (0.40) | 10.9% |
| 205 | 270.0% | 265.2% | 150.0% | 1.8% | 0.65 (0.37) | 11.3% |
| 206 | 150.0% | 147.2% | 65.2% | 1.9% | 0.63 (0.36) | 11.5% |
| 207 | 300.0% | 294.7% | 150.0% | 1.8% | 0.70 (0.40) | 11.1% |
| Comparative Example | | | | | | |
| 32 | — | — | — | 1.8% | 1.18 (0.67) | 8.5% |
| Example | | | | | | |
| 33 | 25.0% | 24.6% | 8.3% | 1.8% | 1.19 (0.68) | 8.4% |
| 34 | 25.0% | 24.6% | 8.3% | 1.8% | 1.02 (0.58) | 9.8% |
| 35 | 25.0% | 24.6% | 8.3% | 1.8% | 1.09 (0.62) | 9.3% |
| 36 | — | — | — | 1.8% | 1.05 (0.6) | 9.4% |
| 37 | — | — | — | 1.8% | 1.07 (0.61) | 9.4% |
| 38 | — | — | — | 1.8% | 1.05 (0.6) | 9.5% |
| 39 | — | — | — | 1.8% | 1.16 (0.66) | 8.7% |
| 40 | — | — | — | 1.8% | 1.14 (0.65) | 8.9% |
| 41 | — | — | — | 1.8% | 1.09 (0.62) | 9.2% |
| 42 | — | — | — | 1.8% | 1.12 (0.64) | 9.0% |
| 43 | — | — | — | 1.8% | 1.12 (0.64) | 9.0% |
| 44 | 25.0% | 24.6% | 5.6% | 1.8% | 1.11 (0.63) | 9.2% |
| 45 | 25.0% | 24.6% | 5.6% | 1.8% | 1.12 (0.64) | 9.0% |
| 46 | 25.0% | 24.6% | 5.6% | 1.8% | 1.11 (0.63) | 9.2% |
| 47 | — | — | — | 1.8% | 1.07 (0.61) | 9.4% |
| Comparative Example | | | | | | |
| 48 | — | — | — | 1.8% | 1.05 (0.6) | 9.5% |
| Example | | | | | | |
| 49 | — | — | — | 1.8% | 1.07 (0.61) | 9.4% |
| 50 | — | — | — | 1.8% | 1.07 (0.61) | 9.4% |
| 51 | — | — | — | 1.8% | 1.09 (0.62) | 9.3% |
| 52 | 25.0% | 24.6% | 4.2% | 1.8% | 1.07 (0.61) | 9.4% |
| 53 | 25.0% | 24.6% | 4.2% | 1.8% | 1.02 (0.58) | 9.6% |
| 54 | 25.0% | 24.6% | 4.2% | 1.8% | 1.00 (0.57) | 9.6% |
| 55 | — | — | — | 1.8% | 1.19 (0.68) | 8.4% |
| 56 | — | — | — | 1.8% | 1.04 (0.59) | 9.7% |
| 57 | — | — | — | — | 2.42 (1.38) | 0.0% |
| 58 | 25.0% | 25.0% | 8.3% | — | 2.42 (1.38) | 0.0% |
| 59 | — | — | — | — | 2.28 (1.3) | 0.1% |
| 60 | 25.0% | 25.0% | 8.3% | — | 2.25 (1.28) | 0.1% |
| 61 | — | — | — | — | 1.93 (1.1) | 0.3% |
| 62 | 25.0% | 25.0% | 8.3% | — | 1.95 (1.11) | 0.3% |

Table 12 shows the "coefficient of kinetic friction" in each of Examples and Comparative Examples as the relative value to the coefficient of kinetic friction in Comparative Example 7 (0.39). Herein, the numerical value in the parentheses is a value obtained by measuring the coefficient of kinetic friction. Table 13 shows the "coefficient of kinetic friction" in each of Examples and Comparative Examples as the relative value to the coefficient of kinetic friction in Comparative Example 54 (0.57). Herein, the numerical value in the parentheses is a value obtained by measuring the coefficient of kinetic friction.

The comparison of Examples with Comparative Examples 1 to 3 reveals that the case where the compound δ is not contained causes a lower proportion of silicon elements in the surface and a higher coefficient of kinetic friction as compared with Examples. Such an effect is exerted even if the types of the resin α, the resin β, the solvent γ and the like are changed.

In addition, the comparison of Examples with Comparative Examples 4 to 6 reveals that the proportion of silicon elements in the surface cannot be made higher and the coefficient of kinetic friction is not lowered even in the case of not having the structure represented by the formula (1) but containing a solvent having the higher boiling point than xylene or toluene (diisobutylketone, n-pentyl acetate). The comparison also reveals that the proportion of silicon elements in the surface cannot be made higher and the coefficient of kinetic friction is not lowered even in the case of a solvent having the structure represented by the formula (1) as long as the solvent is a solvent having the lower boiling point than xylene or toluene (monoglyme). Such an effect is exerted even if the types of the resin α, the resin β, the solvent γ and the like are changed.

It is revealed from Comparative Examples 56 to 61 that in the case of not containing the resin β, the coefficient of kinetic friction is very high and the reduction in friction coefficient due to the addition of the compound δ is not observed regardless of containing the resin having a siloxane structure in the resin α.

It is revealed from Comparative Examples 29 to 31 that in the case of using a dimethylsilicone oil in place of the resin β, the effect due to containing the compound δ is not exerted and the coefficient of kinetic friction is not lowered. It is also revealed that no difference between the case of using monochlorobenzene and the case of using xylene is exhibited in terms of the coefficient of kinetic friction, and little change in initial friction coefficient due to the use of xylene is exhibited in the case of a dimethylsilicone oil.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2011-166765, filed Jul. 29, 2011, and No. 2012-123498, filed May 30, 2012 which are hereby incorporated by reference herein in their entirety.

What is claimed is:

1. A method of producing an electrophotographic photosensitive member comprising a surface layer, the method comprising the steps of:

forming a coat for the surface layer by using a surface-layer coating solution, and forming the surface layer by drying the coat, wherein the surface-layer coating solution comprises:

(α) at least one resin selected from the group consisting of a polycarbonate resin not having a siloxane moiety at the end, and a polyester resin not having a siloxane moiety at the end, (β) at least one resin selected from the group consisting of a polycarbonate resin having a siloxane moiety at the end, a polyester resin having a siloxane moiety at the end, and an acrylate resin having a siloxane moiety at the end, (γ) at least one solvent selected from the group consisting of toluene and xylene, and (δ) a compound having the boiling point in one atmosphere higher than that of the (γ), the compound being represented by the following formula (1), and $$R^{10}O\text{-}E\text{-}(R^{11}O)_q\text{—}R^{12} \quad (1)$$

wherein, in the formula (1), $R^{10}$ represents a methyl group, an ethyl group, a propyl group, a cyclohexyl group, a phenyl group, or a benzyl group, $R^{11}$ represents a methylene group, an ethylene group, or a propylene group, $R^{12}$ represents a methyl group, an ethyl group, an acetyl group, a propionyl group, or a benzoyl group, E represents a single bond or a carbonyl group, q represents an integer number selected from 0 to 2.

2. The method of producing the electrophotographic photosensitive member according to claim 1, wherein the above (δ) is at least one selected from the group consisting of a methyl benzoate, an ethyl benzoate, a benzyl acetate, ethyl 3-Ethoxypropionate, and a diethylene glycol ethyl methyl ether.

3. The method of producing the electrophotographic photosensitive member according to claim 1, wherein the content of the above (δ) in the surface-layer coating solution is not less than 3% by mass and not more than 300% by mass relative to the total mass of the above (α) and the above (β), and the content of the above (δ) is not less than 0.5% by mass and not more than 150% by mass relative to the total mass of the above (γ).

4. The method of producing the electrophotographic photosensitive member according to claim 3, wherein the content of the above (δ) in the surface-layer coating solution is not less than 5% by mass and not more than 80% by mass relative to the total mass of the above (α) and the above (β), and the content of the above (δ) is not less than 0.5% by mass and not more than 40% by mass relative to the total mass of the above (γ).

5. The method of producing the electrophotographic photosensitive member according to claim 1, wherein the content of the above (β) in the surface-layer coating solution is not less than 0.1% by mass and not more than 50% by mass relative to the mass of the above (α).

6. The method of producing the electrophotographic photosensitive member according to claim 1, wherein the surface-layer coating solution further comprises:

(ε) at least one of dimethoxymethane and tetrahydrofuran.

7. The method of producing the electrophotographic photosensitive member according to claim 6, wherein the content of the above (γ) is not less than 15% by mass and not more than 99% by mass relative to the total mass of the above (γ), the above (δ) and the above (ε), the content of the above (δ) is not less than 0.5% by mass and not more than 35% by mass relative to the total mass of the above (γ), the above (δ) and the above (ε), and the content of the above (ε) is not less than 0.1% by mass and not more than 65% by mass relative to the total mass of the above (γ), the above (δ) and the above (ε).

8. The method of producing the electrophotographic photosensitive member according to claim 1, wherein the polycarbonate resin not having a siloxane moiety at the end is a polycarbonate resin A having a repeating structural unit represented by the following formula (A), (A)

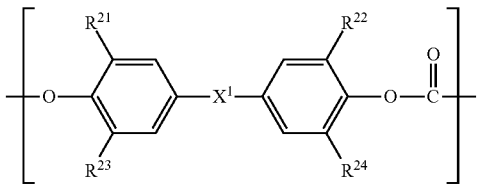

wherein, in the formula (A), $R^{21}$ to $R^{24}$ each independently represents a hydrogen atom, or a methyl group, $X^1$ represents a single bond, a cyclohexylidene group, or a bivalent group having a structure represented by the following formula (C), and (C)

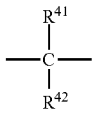

wherein, in the formula (C), $R^{41}$ to $R^{42}$ each independently represents a hydrogen atom, a methyl group, or a phenyl group.

9. The method of producing the electrophotographic photosensitive member according to claim 1, wherein the polyester resin not having a siloxane moiety at the end is a polyester resin B having a repeating structural unit represented by the following formula (B), (B)

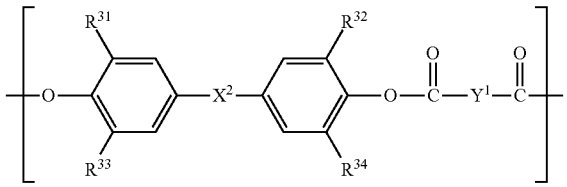

wherein, in the formula (B), $R^{31}$ to $R^{34}$ each independently represents a hydrogen atom, or a methyl group, $X^2$ represents a single bond, a cyclohexylidene group, or a bivalent group having a structure represented by the following formula (C), $Y^1$ represents a meta-phenylene group, a para-phenylene group, or a bivalent group having two para-phenylene groups bonded with an oxygen atom, and (C)

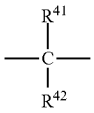

wherein, in the formula (C), $R^{41}$ to $R^{42}$ each independently represents a hydrogen atom, a methyl group, or a phenyl group.

10. The method of producing the electrophotographic photosensitive member according to claim 1, wherein the polycarbonate resin having a siloxane moiety at the end is a polycarbonate resin D having a repeating structural unit represented by the following formula (A'), and a end structure represented by the following formula (D), (A')

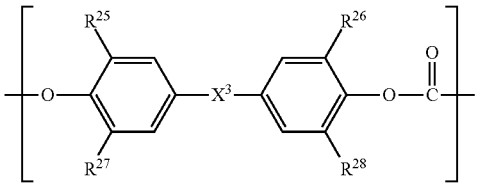

wherein, in the formula (A'), $R^{25}$ to $R^{28}$ each independently represents a hydrogen atom, or a methyl group, $X^3$ represents a single bond, a cyclohexylidene group, or a bivalent group having a structure represented by the following formula (C'), and (C')

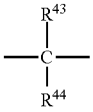

wherein, in the formula (C'), $R^{43}$ to $R^{44}$ each independently represents a hydrogen atom, a methyl group, or a phenyl group, and (D)

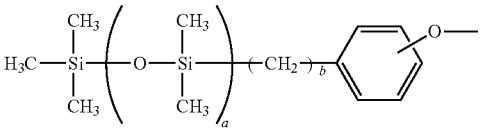

wherein, in the formula (D), a and b each independently represents number of repetitions of a structure within the bracket, an average of a in the polycarbonate resin D ranges from 20 to 100, an average of b in the polycarbonate resin D ranges from 1 to 10.

11. The method of producing the electrophotographic photosensitive member according to claim 1, wherein the polyester resin having a siloxane moiety at the end is a polyester resin E having a repeating structural unit represented by the following formula (B'), and a end structure represented by the following formula (D), (B')

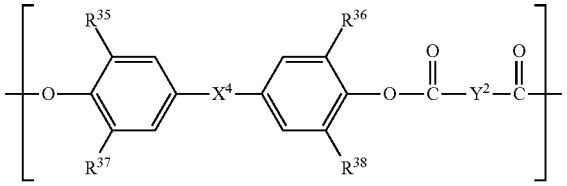

wherein, in the formula (B'), $R^{35}$ to $R^{38}$ each independently represents a hydrogen atom, or a methyl group, $X^4$ represents a single bond, a cyclohexylidene group, or a bivalent group having a structure represented by the following formula (C'), $Y^2$ represents a meta-phenylene group, a para-phenylene group, or a bivalent group having two para-phenylene groups bonded with an oxygen atom, and (C')

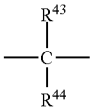

wherein, in the formula (C'), $R^{43}$ to $R^{44}$ each independently represents a hydrogen atom, a methyl group, or a phenyl group, and (D)

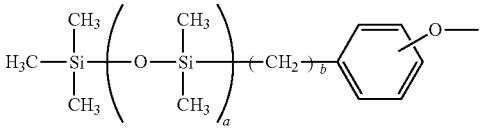

wherein, in the formula (D), a and b each independently represents number of repetitions of a structure within the bracket, an average of a in the polyester resin E ranges from 20 to 100, an average of b in the polyester resin E ranges from 1 to 10.

12. The method of producing the electrophotographic photosensitive member according to claim 1, wherein the acrylate resin having a siloxane moiety at the end is a acrylate resin F having a repeating structural unit represented by the following formula (F-1) and a repeating structural unit represented by the following formula (F-2), or a acrylate resin F having a repeating structural unit represented by the following formula (F-3), (F-1)

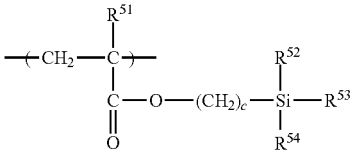

wherein, in the formula (F-1), $R^{51}$ represents a hydrogen atom, or a methyl group, c represents number of repetitions of a structure within the bracket, an average of c in the acrylate resin F ranges from 0 to 5, $R^{52}$ to $R^{54}$ each independently represents a structure represented by the following formula (F-1-2), a methyl group, a methoxy group, or a phenyl group, (F-1-2)

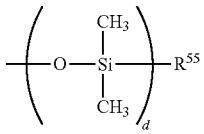

wherein, in the formula (F-1-2), d represents number of repetitions of a structure within the bracket, an average of d in the acrylate resin F ranges from 10 to 50, $R^{55}$ represents a methyl group, or a hydroxyl group, and (F-2)

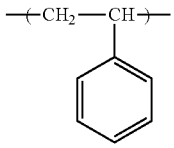

(F-3)

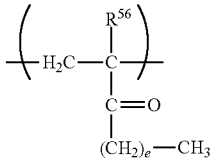

wherein, in the formula (F-3), $R^{56}$ represents a hydrogen group, a methyl group, or a phenyl group, and e is 0 or 1.

13. The method of producing the electrophotographic photosensitive member according to claim 1, wherein the above (γ) is xylene.

* * * * *